US006332311B1

(12) United States Patent
Todo et al.

(10) Patent No.: US 6,332,311 B1
(45) Date of Patent: Dec. 25, 2001

(54) HAIRINESS SUPPRESSING DEVICE FOR AUTOMATIC WINDER

(75) Inventors: Yuji Todo, Nagaokakyo; Hidetoshi Kimura; Koji Takayasu, both of Kyoto, all of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/471,378

(22) Filed: Dec. 23, 1999

(30) Foreign Application Priority Data

Dec. 25, 1998 (JP) ..... 10-368572
Mar. 29, 1999 (JP) ..... 11-85603
Nov. 11, 1999 (JP) ..... 11-321080

(51) Int. Cl.[7] ..... D01H 7/00

(52) U.S. Cl. ..... 57/350; 57/62; 57/245; 57/261; 57/333; 242/42; 242/128

(58) Field of Search ..... 57/62, 245, 261, 57/333, 350; 242/42, 128

(56) References Cited

U.S. PATENT DOCUMENTS 4,619,109 * 10/1986 Suzuki et al. ..... 57/261
5,263,311 * 11/1993 Feil et al. ..... 57/333
5,802,831 * 9/1998 Imamura ..... 57/261

FOREIGN PATENT DOCUMENTS 6-76175 9/1994 (JP) .
676175 * 9/1994 (JP) .

* cited by examiner

*Primary Examiner*—John J. Calvert
*Assistant Examiner*—Shaun R Hurley
(74) *Attorney, Agent, or Firm*—Armstrong, Westerman, Hattori, McLeland & Naughton, LLP

(57) ABSTRACT

The present invention provides a hairiness suppressing device for an automatic winder that can perfectly balloon a spun yarn using a whirling current in a yarn passage. In a hairiness suppressing device (1) comprising a yarn inserting opening (9) that extends and opens in an axial direction of a yarn passage (8) in which a whirling current acts on a spun yarn, a wedge-shaped cover member (29) is provided that can open and close the yarn inserting opening (9). When a swiveling body (26) is swivellably moved to open the cover member (29), the yarn can be introduced into the yarn passage (8) through the yarn inserting opening (9). When the swiveling body (26) is swivellably moved to close the cover member (29), the whirling current in the yarn passage (8) is prevented from leaking from a side of the yarn passage (8).

16 Claims, 21 Drawing Sheets

VIII-VIII SECTIONAL VIEW

IX-IX SECTIONAL VIEW

C PERSPECTIVE VIEW

XI-XI SECTIONAL VIEW

HAIRINESS SUPPRESSING DEVICE FOR AUTOMATIC WINDER

FIELD OF THE INVENTION

The present invention relates to a hairiness suppressing device provided in a yarn path of an automatic winder that unwinds a spun yarn on a supplying side to wind it around a package.

BACKGROUND OF THE INVENTION

For example, supplying bobbins around which spun yarns produced by means of ring spinning have been wound are transferred to an automatic winder, where the yarns from a large number of supplying bobbins are spliced together while defects in the yarns are being eliminated. Thus, the yarns are rewound into corn-shaped or cheese-shaped packages.

This rewinding executed by the automatic winder comprises a step for using a tenser to apply tension to the yarn rewound from the supplying bobbin while using a large number of yarn guides to guide the yarns to form them into a package. Thus, each time a yarn formed by twisting short fibers passes through the tenser or the yarn guide, the yarn, on which hairinesses have been present since the yarn was located on a supplying bobbin, tends to be subjected to friction and to have more hairinesses after the rewinding.

Thus, in the rewinding step in the conventional automatic winder, a hairiness suppressing device is provided in a yarn path to suppress hairinesses. This hairiness suppressing device carries out hairiness suppressing processing by jetting a gas such as air into a yarn passage through which the yarn passes in order to cause a whirling current, thereby ballooning the yarn to entangle hairinesses with the fibers for suppressing, or by using the ballooning to fly away the hairiness by force.

The hairiness suppressing device is structured to have a yarn insertion opening that extends and opens in an axial direction of the yarn passage so that a yarn is inserted into the yarn passage through this yarn insertion opening.

The prior art, however, has the following problems.

First, according to the conventional hairiness suppressing device, the yarn insertion opening is formed in the yarn passage in which a whirling current of a gas acts on a yarn, so the whirling current may leak from the yarn insertion opening and the yarn ballooning caused by the whirling current may become insufficient to preclude the ballooning-induced hairiness suppressing effect from being obtained as expected. A hairiness suppressing device that is divided into two so as to be opened and closed has been provided. Since, however, the abutting surfaces of these two parts cannot be aligned easily, it is difficult to perfectly prevent the whirling current from leaking from the side of the yarn passage.

Second, the conventional hairiness suppressing device can suppress hairinesses by ballooning the yarn, but dust or fluff adhering to the yarn may be entangled with and caught in the fibers together with the hairinesses. This entanglement of dust or fluff with the fibers degrades the quality of packages.

Then, there is a third following problem. A yarn rewinding device (an automatic winder) has disposed therein a slab catcher or a yarn clearer that can detect and remove defects in the yarn such as slabs, or those portions that have a thickness smaller or larger than a predetermined value. These devices, however, cannot detect those portions that have been weakened due to insufficient twisting, despite the lack of appearance defects. With a yarn that has a weak portion and that has not been detected by the slab catcher or yarn clearer, this portion may be cut during a subsequent step such as a warping step to reduce the working efficiency of this step.

In addition, although a known yarn processing method and device suppresses hairinesses by passing a spun yarn through a whirling air current, it cannot hold the yarn at the center of a gate to a whirling air current generation member that generates a whirling air current. Consequently, the yarn is insufficiently ballooned in the whirling air current generation member to prevent the desired suppression on hairinesses.

Furthermore, a fourth problem is that the conventional hairiness suppressing device cannot provide the effect of suppressing hairiness of a spun yarn as expected even by ballooning the yarn.

The present invention is provided in view of these problems, and its first object is to provide a hairiness suppressing device for an automatic winder that enables a spun yarn to be perfectly ballooned using a whirling current in a yarn passage.

The second object of the present invention is to provide a hairiness suppressing device that can suppress dust or fluff adhering to a spun yarn from being entangled with or caught in the fibers while hindering hairiness generation from being formed on a yarn being wound around a package by a winder.

The third object of the present invention is to solve the problems of the above conventional yarn processing methods and apparatuses in order to provide a spun yarn processing method and device that can remove weak portions of a yarn while simultaneously suppressing hairinesses.

Furthermore, a fourth object of the present invention is to provide a hairiness suppressing device capable of fully exhibiting a hairiness suppressing function and an automatic winder having integrated therein a mechanism for suppressing hairinesses.

That is, the present invention has been created to improve spun yarn hairiness suppressing methods and devices.

SUMMARY OF THE INVENTION

To achieve the first object, the hairiness suppressing device of the invention is a hairiness suppressing device provided in a yarn path of an automatic winder that unwinds a spun yarn on a supplying side to wind it around a package, the device comprising a yarn passage in which a whirling current acts on the yarn and a yarn insertion opening that extends and opens in an axial direction of the yarn passage, characterized in that the device comprises a cover member that can open and close the yarn insertion opening.

To introduce the yarn into the yarn passage, the cover member is opened and the yarn is introduced into the yarn passage from the yarn insertion opening. Subsequently, the cover member is closed to close the yarn insertion opening. Then, the side of the yarn passage in which a whirling current acts on the yarn is closed to prevent the flow from leaking from the side, thereby enabling the yarn to be effectively ballooned while reducing energy losses caused by the leakage of the whirling current.

The aspect of the present invention is a hairiness suppressing device for an automatic winder, wherein the hairiness suppressing device comprises a yarn presser guide that can pivotably move to advance to or withdraw from a gate of the yarn passage and the cover member is provided for the yarn pressure guide.

The yarn presser guide is provided at each of the upper outlet and lower inlet gates to the yarn passage, and when swivelled to advance, constitutes an upper and a lower node for ballooning the yarn. When, however, the yarn is introduced into the yarn passage through the yarn insertion opening, the cover member is swivelled to withdraw so as not to obstruct the introduction. Since the cover member is provided for the yarn presser guide, the cover member opens and closes the yarn insertion opening in response to the advancement and withdrawal of the yarn presser guide associated with its swiveling movement.

The aspect of the present invention is a hairiness suppressing device for an automatic winder, wherein the cover member is shaped like a wedge that is fitted in the yarn insertion opening.

The yarn insertion opening is preferably formed of a slit section located in an axial direction of the yarn passage and a fan-shaped enlarged section that spreads like a fan from the slit section. By tightly fitting the wedge-shaped cover member in the fan-shaped enlarged section, the yarn insertion opening is entirely blocked except for the slit section to substantially prevent leakage from the side of the yarn passage.

To achieve the second object, the present invention provides a hairiness suppressing device provided in a yarn path of an automatic winder that releases a spun yarn on supplying side to wind it around a package, characterized in that the device comprises a jet nozzle means having a yarn passage through which the unwound yarn passes and jet holes that open into the jet nozzle means and from which a whirling air current is provided when a gas is jetted into the yarn passage, and suction means provided in the jet nozzle means to suck the inside of the yarn passage.

Thus, by using a whirling air current in the yarn passage to balloon (whirl) and false-twist a yarn, hairiness suppressing processing can be carried out that entangles hairinesses with the fibers for suppressing. Simultaneously with the hairiness suppressing processing, the inside of the yarn passage can be sucked to suck and remove dust or fluff leaving the yarn due to the whirling air current or the ballooning (whirling) of the yarn. Consequently, the yarn can be subjected to the hairiness suppressing processing in a clean state.

In addition, if a yarn trap of the winder is also used as the suction means, the device existing in the winder can be used to suck and remove dust or fluff.

Furthermore, by using the suction means to carry out suction in the tangential direction of a whirling air current, dust or fluffs can be efficiently sucked and reliably removed from the yarn passage without disturbing the whirling air current in the yarn passage.

According to the present invention, the first feature provided to achieve the third object is as follows; at a gate of a vertical hole of a whirling air current generation member for generating a whirling air current, a spun yarn is held approximately at the center of the vertical hole in the whirling air current generation member, the whirling air current is used to balloon the yarn to suppress hairinesses and to cut a weak portion of the yarn. Second, the device comprises a whirling air current generation member for generating a whirling air current, and a means for holding a spun yarn approximately at the center of a vertical hole in the whirling air current generation member. Third, the means for holding a spun yarn approximately at the center of the vertical hole in the whirling air current generation member comprises a fixed guide member disposed at. the gate of the whirling air current generation member and a movable guide member that is urged toward the fixed guide member.

In order to achieve the fourth object, the present invention provides a hairiness suppressing device provided in a path for a spun yarn formed by twisting fibers, characterized in that the device comprises nozzle means having a yarn passage through which the yarn passes and holes from which a gas is jetted to cause a whirling current in the yarn passage, and twisting stop means provided at at least either the inlet or outlet of the yarn passage to substantially stop twisting applied to the yarn by the whirling current from propagating beyond at least either the inlet or outlet. In addition, the twisting stop means is preferably provided at both the inlet and outlet of the yarn passage to substantially stop twisting applied to the yarn by the whirling current from propagating to the upstream and downstream side of the yarn passage.

The results of various experiments conducted by the inventors show that insufficient hairiness suppression is achieved by simply ballooning a spun yarn because ballooning may cause twisting applied to the yarn to propagate to the upstream and downstream sides of the yarn passage. The inventors have found that if yarn false-twisting.based on untwisting and additional twisting is carried out within a short section, hairinesses can be effectively entangled with and caught in the fibers, or untwisting or ballooning during untwisting effectively flings away unwanted fibers that do not contribute to construction of the yarn. Thus, hairinesses can be effectively suppressed by the twisting stop means for substantially stop twisting applied to the yarn by the whirling current from propagating to at least either the upstream or downstream side of the yarn passage. Preferably, the twisting stop means is provided at both the upstream and downstream sides of the yarn passage. The expression "substantially stop twisting" refers to stopping almost all of the propagation of twisting applied to the yarn by the whirling current, so that the yarn is false-twisted based on untwisting and additional twisting between the twisting stop means.

In order to carry out effective hairiness suppression, the whirling current is formed in such a direction as to twist the yarn at the outlet side of the yarn passage. This is because a higher hairiness suppressing effect can be obtained by additionally twisting the yarn to catch hairinesses thereon after the yarn has been untwisted to fling away unwanted fibers than by untwisting the yarn after additional twisting. In this case, the twisting stop means is preferably provided at at least the outlet side of the yarn passage. In addition, to stably balloon the yarn to allow the whirling current to reliably twist it, the twisting stop means preferably holds the yarn at the inlet and outlet of the yarn passage so that the yarn is located at the center of the circular cross section of the yarn passage.

In addition, to stop twisting without subjecting the yarn to a large tension, the twisting stop means preferably comprises two guide members provided at the inlet and outlet of the yarn passage, respectively, so that the two guide members substantially stop propagation of the twisting. Such twisting stop means may comprise first guide members disposed closer to the inlet and outlet of the yarn passage, respectively, to position the yarn approximately at the center of the circular cross section of the yarn passage, and second guide members disposed farther from the inlet and outlet of the yarn passage, respectively, to bend the yarn positioned by the first guides, from the center.

In addition, to reliably move the yarn into and out from the yarn passage, the yarn passage has an opening into which the yarn is inserted and which extends in a direction along the central axis, the first guide member is fixed to a predetermined position and has a recess section that opens to the opening side, and the second guide member can be moved between a position at which the yarn is bent and held in the recess section of the first guide and a position at which the yarn can be introduced into the recess section of the first guide.

In order to achieve the above object, the present invention provides an automatic winder for unwinding a spun yarn wound around a supplying bobbin to rewind it into a package, characterized in that the winder comprises a yarn passage provided in a yarn guide for the unwound yarn and holes from which a gas is jetted to cause a whirling current in the yarn passage, and twisting stop means provided at at least either the inlet or outlet of the yarn passage to substantially stop twisting applied to the yarn by the whirling current from propagating beyond at least either the inlet or outlet and to hold the yarn at least either the inlet or outlet of the yarn passage so that the yarn is located at the center of the circular cross section of the yarn passage.

Hairiness suppression is effectively carried out by carrying out spun yarn untwisting and additional twisting within a short section so that hairinesses that may occur during unwinding of the yarn from a supplying bobbin or during passing the yarn through a tensioner are entangled with and caught in the fibers. Alternatively, hairiness suppression is effectively executed by using untwisting or ballooning during untwisting to fling away unwanted fibers that do not contribute to construction of the yarn.

DETAILED DESCRIPTION OF THE PREFERRED EMBODIMENTS

The embodiments of the present invention are described below with reference to the drawings.

Figure 1:
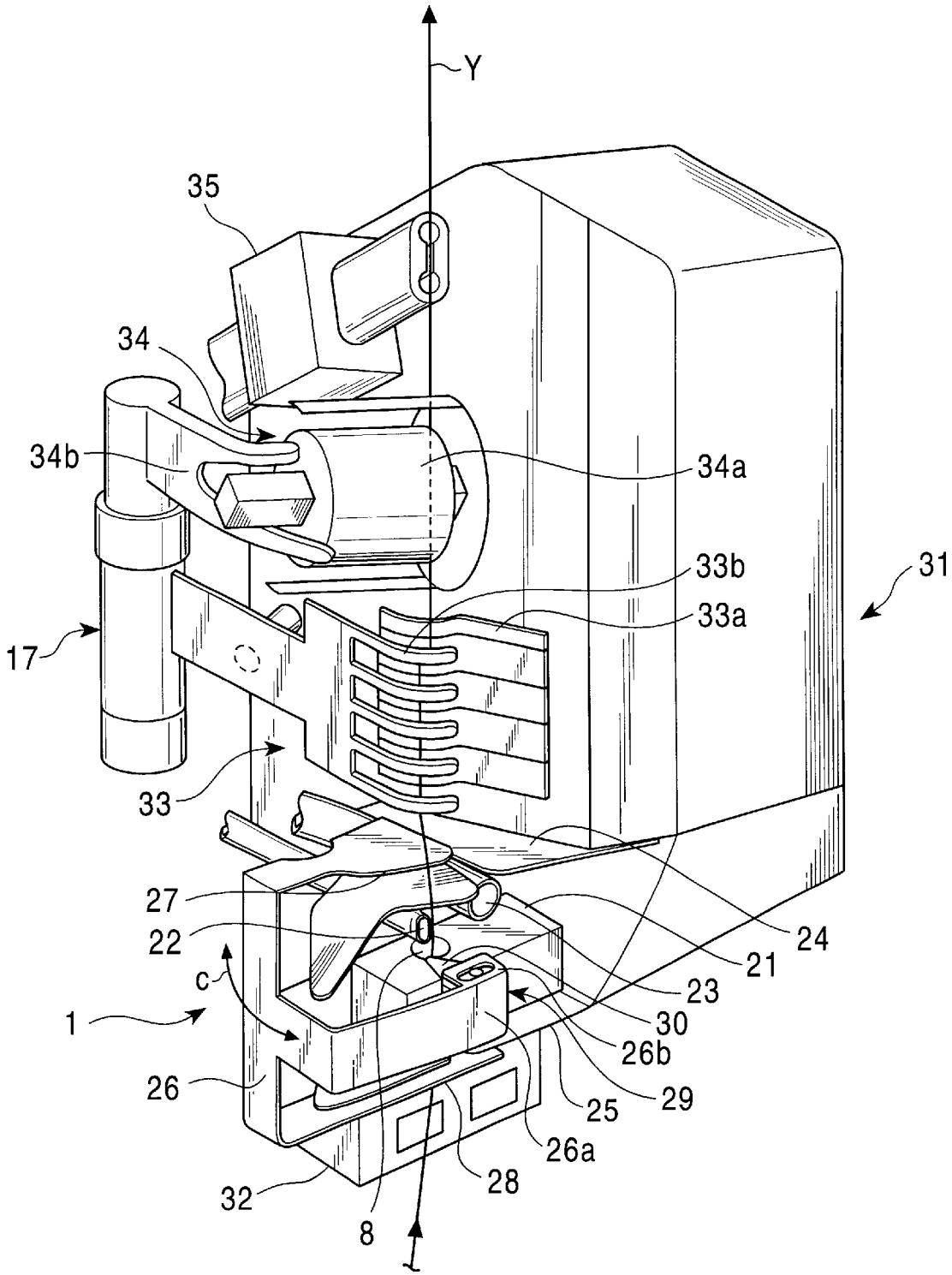
FIG. 1 is a perspective view of the integral part of an automatic winder having installed therein a hairiness suppressing device according to a first embodiment.
Figure 2:
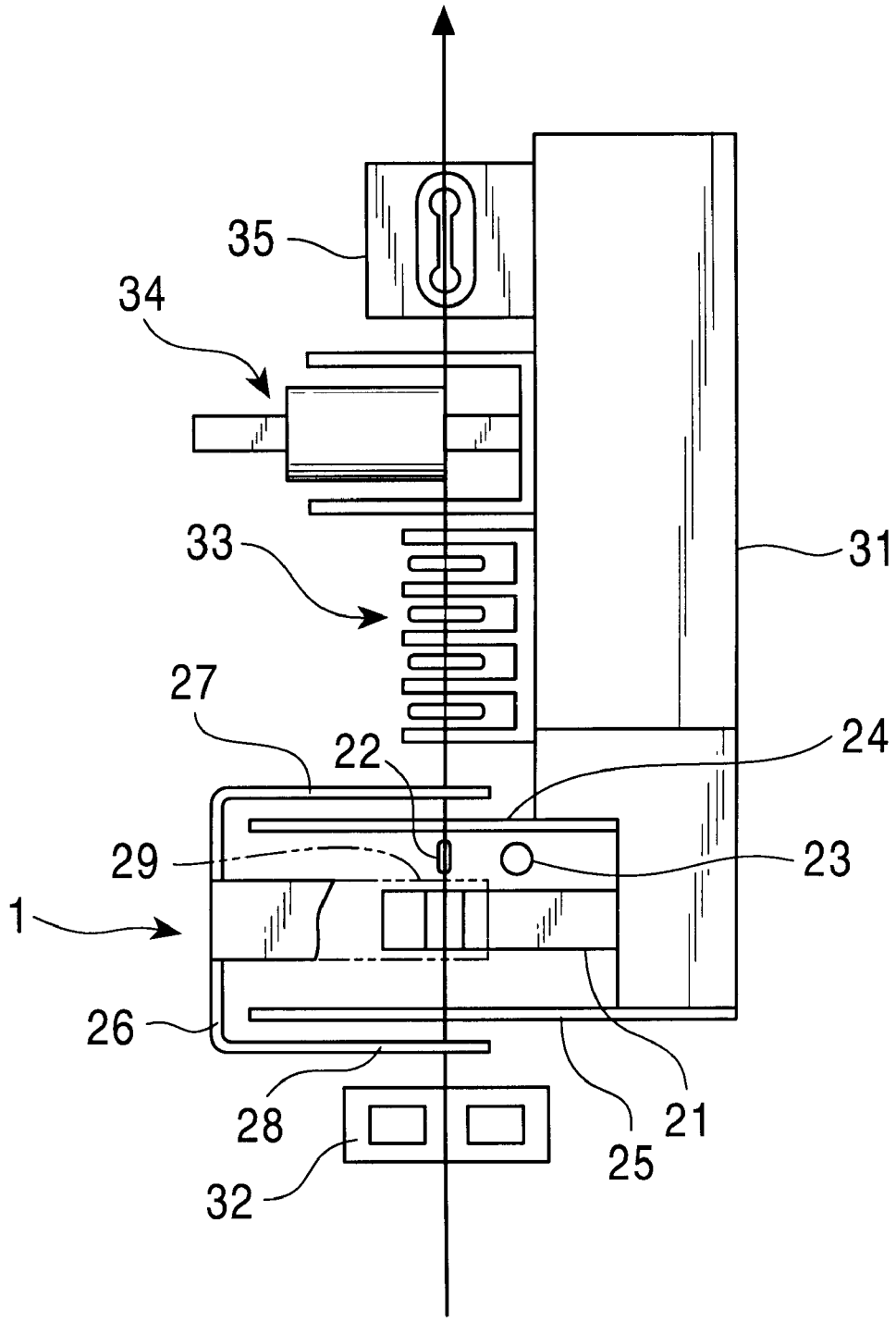
FIG. 2 is a front view of the integral part of the automatic winder having the hairiness suppressing device installed therein.

The hairiness suppressing device 1 shown in FIGS. 1 and 2 is provided in a tenser box 31 of the automatic winder. The tenser box 31 is configured as a unit comprising a lower yarn detector 32 using a photoelectric sensor, a hairiness suppressing device 1, a gate tenser 33, a waxing device 34, and a suction nozzle 35 arranged in the order from a supplying side (an upstream side) for a spun yarn (a yarn formed by twisting fibers) that runs to a package.

The hairiness suppressing device 1 comprises a central nozzle body 21, a blowout hole 22 disposed along a yarn path above the nozzle body 21, a suction nozzle 23 at the side of the blowout hole 22, the first yarn guide plate 24 and the second yarn guide plate 25 located above and below the central nozzle body 21, the first yarn presser guide 27 and the second yarn presser guide 28 provided at the top and bottom of a swiveling body, and a cover member 29.

Figure 3:
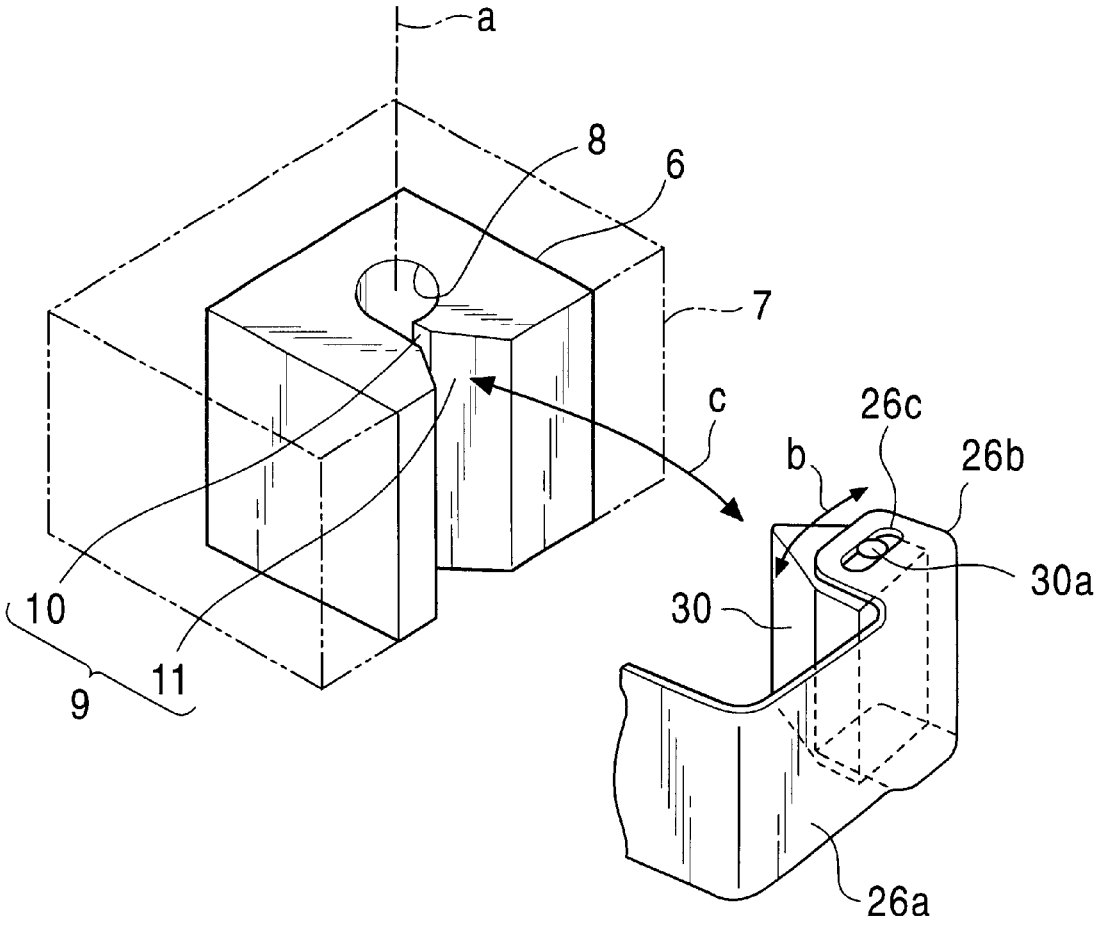
FIG. 3 is a perspective view of the integral part of the hairiness suppressing device.

As shown in FIG. 3, the integral nozzle body 21 is obtained by fitting a ceramics element 6 in a nozzle holder 7 having a recess cross section and tightening the element using bolts (not shown in the drawings). The element 6 has formed therein a long yarn passage 8 penetrating the element at its axis (a) and having a circular cross section and has formed therein an opening 9 extending in the direction of the axis (a) of the yarn passage 8. A yarn is inserted into the opening 9, and the opening 9 comprises a slit section 10 that directly opens into the yarn passage 8 and a fan-shaped enlarged section 11 that connects to the slit section 10. A yarn is introduced into the yarn passage 8 through the fan-shaped enlarged section 11 and the slit section 10. The slit section 10 is formed parallel with and eccentrically to the axis (a) of the yarn passage 8 and in a tangential direction of the yarn passage 8. The slit section 10 is open over the length of the axis (a) of the yarn passage 8.

Figure 4:
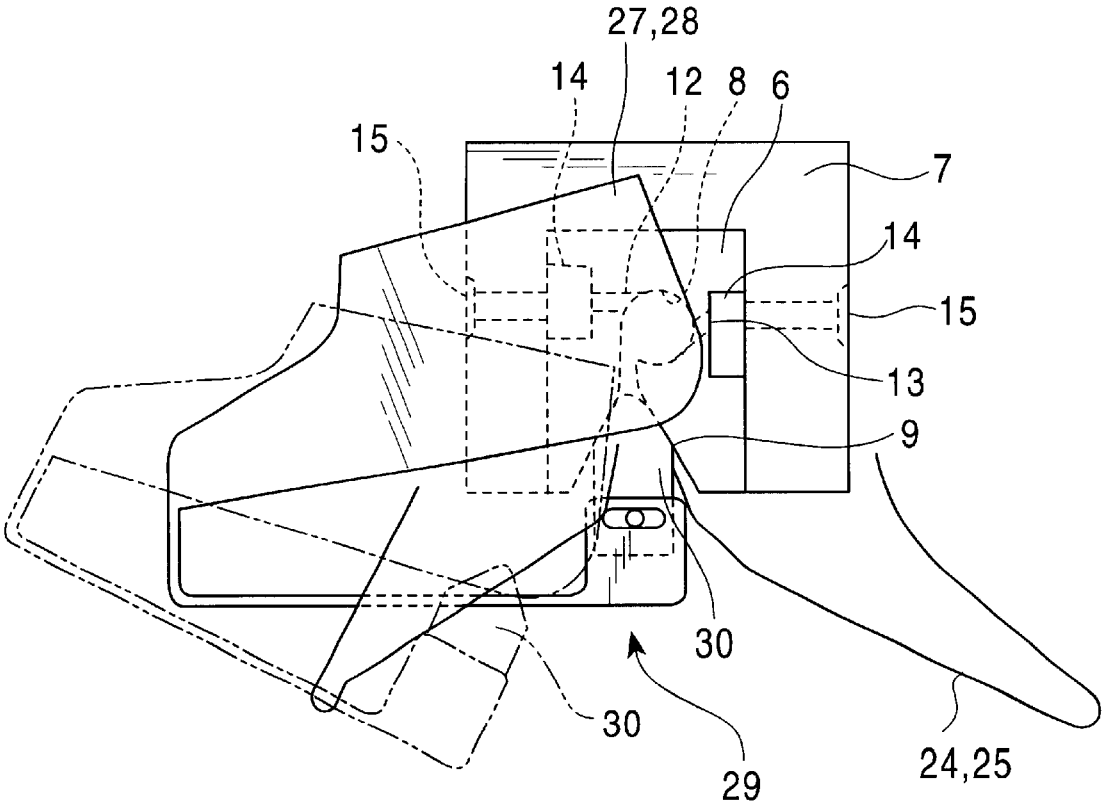
FIG. 4 is a top view of the hairiness suppressing device.

In the element 6, a plurality of jet holes 12, 13 that jet a gas such as air, humidified air, or steam are formed in the yarn passage 8, as shown in FIG. 4. Each of the jet holes 12, 13 is formed around the yarn passage 8 except for the opening 9 and opens into the yarn passage 8 horizontally from the tangential direction of the inner circumference of the yarn passage 8. Each jet hole 12, 13 is in communication with a port 15 via a header section 14. The port section 15 is connected to air supply equipment (not shown in the drawings) via each pipe (not shown in the drawings).

During a time period other than a winding step, for example, during yarn splicing, air is blown out from the blowout hole 22 shown in FIG. 1 to clean the top of the yarn passage 8. The suction nozzle 23 at the side of the blowout hole 22 sucks fluff blown up from the yarn passage 8 and constantly executes sucking.

The first and second guide plates 24, 25 shown in FIG. 1 guide a lower yarn carried by a lower yarn suction pipe (not shown in the drawings) to the yarn insertion opening 9 in the nozzle body 21, and are formed to have right and left receiving sections leading to a central guide port. with the top and bottom of the swiveling body 26 and can be swiveled around a support shaft (not shown in the drawings) provided behind the swiveling body 26. As shown in FIG. 4, the first and second yarn presser guides 27, 28 are swivellably moved so as to advance and withdraw between an advanced position, which is shown by the solid line, and a withdrawn position, which is shown by the chain double-dashed line. At the advanced position shown by the solid line, the tips of the first and second yarn presser guides 27, 28 cover the yarn passage 8. Thus, nodes of yarns are formed at the top and bottom of the yarn passage 8 to ensure that the yarn is ballooned in the yarn passage 8.

The cover member 29 shown in FIG. 1 is structured to hold a wedge member 30 in a holder section 26*b* so as to oscillate, wherein the holder section 26*b* is located at the tip of an arm section 26*a* extending from the center of the swiveling body 26. The wedge member 30 has a tip shape that is tightly fitted in the fan-shaped enlarged section 11, as shown in FIG. 3. A vertical shaft 30*a* of the wedge member 30 engages with long holes 26*c* in the holder section 26*b* so that the wedge member 30 can oscillate in the direction shown by arrow (b) and can move laterally. When the arm section 26*a* is swivellably moved in the direction shown by arrow (c), the tip of the wedge member 30 enters the fan-shaped enlarged section 11 and moves in such a way as to adapt itself to the fan-shaped enlarged section 11 until the wedge member 30 is tightly fitted in the fan-shaped enlarged section 11. FIG. 4 shows the fitted state. The opening 9 that opens into the yarn passage 8 is closed to prevent air from leaking from the side of the yarn passage 8.

When a spun yarn is cut by a cutter (not shown in the drawings) having a yarn holding function, the lower yarn detector 32 in FIG. 1 checks whether a lower yarn (a yarn of supply side) is held. Without a lower yarn, the yarn cannot be spliced. The gate tenser 33 has a movable comb edge 33*b* that can open and close a fixed comb edge 33*a* and can be switched between a meshing position at which the comb edges 33*a*, 33*b* mesh with each other and an open position at which a yarn can be introduced. While the comb edges 33*a*, 33*b* are closed, a zigzag yarn path is formed to apply a predetermined tension to a running yarn.

The waxing device 34 abuts a running yarn Y on an end face of a roll 34*a* made of wax in order to apply wax to the yarn. In order to allow the end face of the roll 34*a* to be worn uniformly, the roll 34*a* is rotated at a low speed and an arm 34*b* applies a predetermined pressure to a yarn. The arm 34*b*, the movable comb edge 33*b*, and the swiveling body 26 are concurrently opened and closed by a common drive section 17. The suction nozzle 35, which is shaped like a nozzle, sucks and captures the end of an extra cut yarn, and is connected to suction equipment (not shown in the drawings).

Next, an operation of the hairiness suppressing device 1 is explained with reference to FIG. 1.

During yarn splicing, an extra end Y is sucked into the suction nozzle 35, the roll 34*a* of the waxing device 34 is withdrawn from the yarn path, and the movable comb edge 33*b* of the gate tenser 33 is opened. The swiveling body 26 is moved to a withdrawn position, and air is blown out from the blowout hole 22 to clean the top of the yarn passage 8. That is, as shown by the chain double-dashed line in FIG. 4, the upper and lower yarn presser guides 27, 28 exit from a position at which they cover the yarn passage 8, and the wedge member 30 of the cover member 29 exits from the yarn introducing opening 9. Thus, a yarn can be introduced via the upper and lower guide plates 24,25 and the yarn introducing opening 9 into the yarn passage 8. In FIG. 1, when the lower yarn suction pipe (not shown in the drawings) lifts a lower yarn, the yarn is simultaneously shifted toward the illustrated yarn path. At this point, the hairiness suppressing device 1, the tenser 33, and the waxing device 34 are open, so the yarn Y runs as shown in the drawing.

The drive device 17 directs the roll 34*a* of the waxing device 34 toward the yarn path, closes the movable comb edge 33*b* of the gate tenser 33, and moves the swiveling body 26 to an advanced position. Then, as shown by the solid line in FIG. 4, the upper and lower yarn presser guides 27, 28 advance to the position at which they cover the yarn passage 8, and the wedge member 30 of the cover member 29 is also tightly fitted in the fan-shaped enlarged section 11 of the yarn introducing opening 9. In these conditions, a gas is jetted into the yarn passage 8 from the jet holes 12, 13, and the yarn is wound to run. Then, a whirling current is formed in the yarn passage 8 to balloon the yarn using as nodes the yarn presser guides 27, 28 of the yarn passage 8. By ballooning the yarn formed by twisting fibers, hairiness suppressing processing is executed that entangles hairinesses protruding fibers, with the fibers for suppressing or that uses the ballooning to flying away long hairinesses by force. Hairinesses and fluffs contained in an air current blown out from the yarn path are sucked by the suction nozzle 23.

At this point, as shown in FIG. 1, the yarn introducing opening 9 is tightly closed by a cover member 29, so no whirling current flows from the side of the yarn passage 8. Thus, the yarn is perfectly ballooned in the yarn passage 8 to allow the hairiness suppressing processing to be effectively executed. In addition, since no whirling current leaks from the side of the yarn passage 8, the amount of compressed air required to form a whirling current is reduced to minimize energy losses.

In addition to air and humidified air, steam can be used as a gas for ballooning the yarn Y formed by twisting fibers. In particular, both the yarn Y passing through the yarn passage 8 and the inner circumferential surface of the yarn passage 8 can be heated using steam. The steam also enables the hairinesses on the yarn Y to be softened. Thus, the yarn Y, which is ballooned in such a way as to slide through the inner circumferential surface of the yarn passage 8, enables its hairinesses that have been softened by twisting to be effectively entangled with and caught in the fibers, while due to contact with the inner circumferential surface of the yarn passage 8, the yarn Y is heat-set as if it was ironed, thereby maintaining a form with a reduced number of hairinesses.

Figure 5:
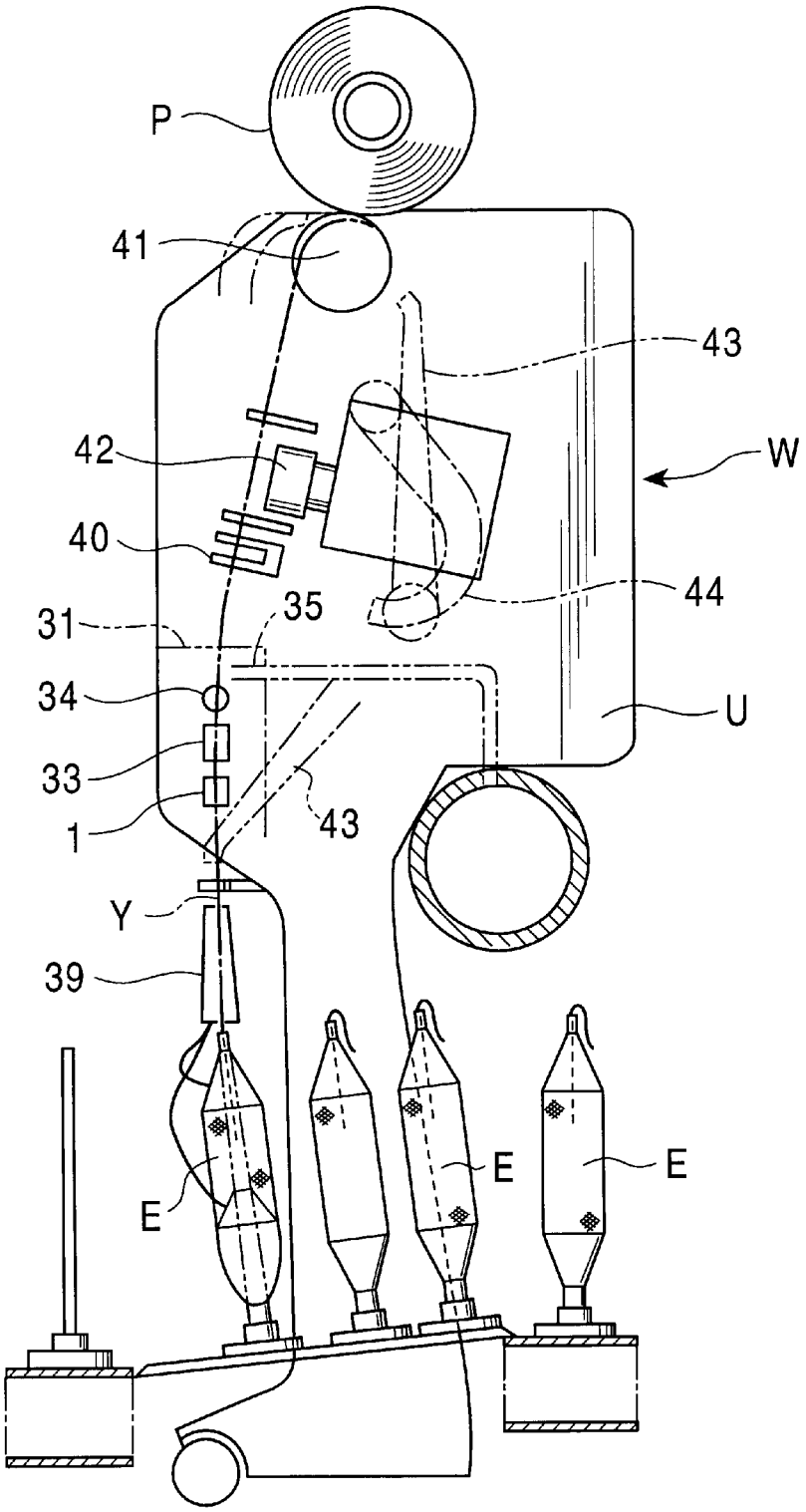
FIG. 5 shows the arrangement of equipment in the automatic winder to which the hairiness suppressing device has been applied.

Next, an automatic winder having the hairiness suppressing device 1 installed therein is described with reference to FIG. 5.

An automatic winder W comprises a large number of winding units installed in a line, and each winding unit U comprises the tenser box 31 in FIG. 1. Each winding unit U comprises a mechanism for passing the yarn Y unwound from a supplying bobbin E supplied at a predetermined position, through a balloon breaker 39, the hairiness suppressing device 1, tenser 33, waxing device 34, and suction nozzle 35 of the tenser box 31, and a slab catcher 40 that detects a defect in the yarn Y, before winding the yarn around a package P rotated by a traverse drum 41. 42 is a yarn splicing device, 44 is a suction (upper yarn suction pipe) mouth that guides the yarn end on the package P side to the yarn splicing device 42, and 43 is a relay (lower yarn suction pipe) pipe that guides the lower yarn of the supplying bobbin E side to the yarn splicing device 42.

When the traverse drum 41 of each winding unit U is driven to start rewinding the yarn Y, the yarn Y is unwound from the supplying bobbin E and is subjected to the hairiness suppressing processing that uses a whirling current to balloon the yarn while it is passing through the hairiness suppressing device. If any defect is found in the yarn being wound around the package P, the yarn must be spliced. In this case, the jetting of a gas from the nozzle body 21 of the hairiness suppressing device 1 is stopped, and an extra yarn end is sucked and captured by the suction nozzle 35. The relay pipe 43 is swiveled to the neighborhood of the balloon breaker 39 to suck the lower yarn captured by a means (not shown in the drawings) and then to guide it to the yarn splicing device 42. At this point, each equipment of the tenser box 31 is open and the yarn Y runs along the illustrated yarn path. At the same time, the suction mouth 44 sucks the yarn end on the package P side to guide it to the yarn splicing device 42, which then splices the yarn. Once the splicing has been finished, each equipment of the tenser box 31 is activated to start winding the yarn Y while carrying out the hairiness suppressing processing.

A hairiness suppressing device according to the present invention for achieving the second object is described below with reference to the drawings.

Figure 6:
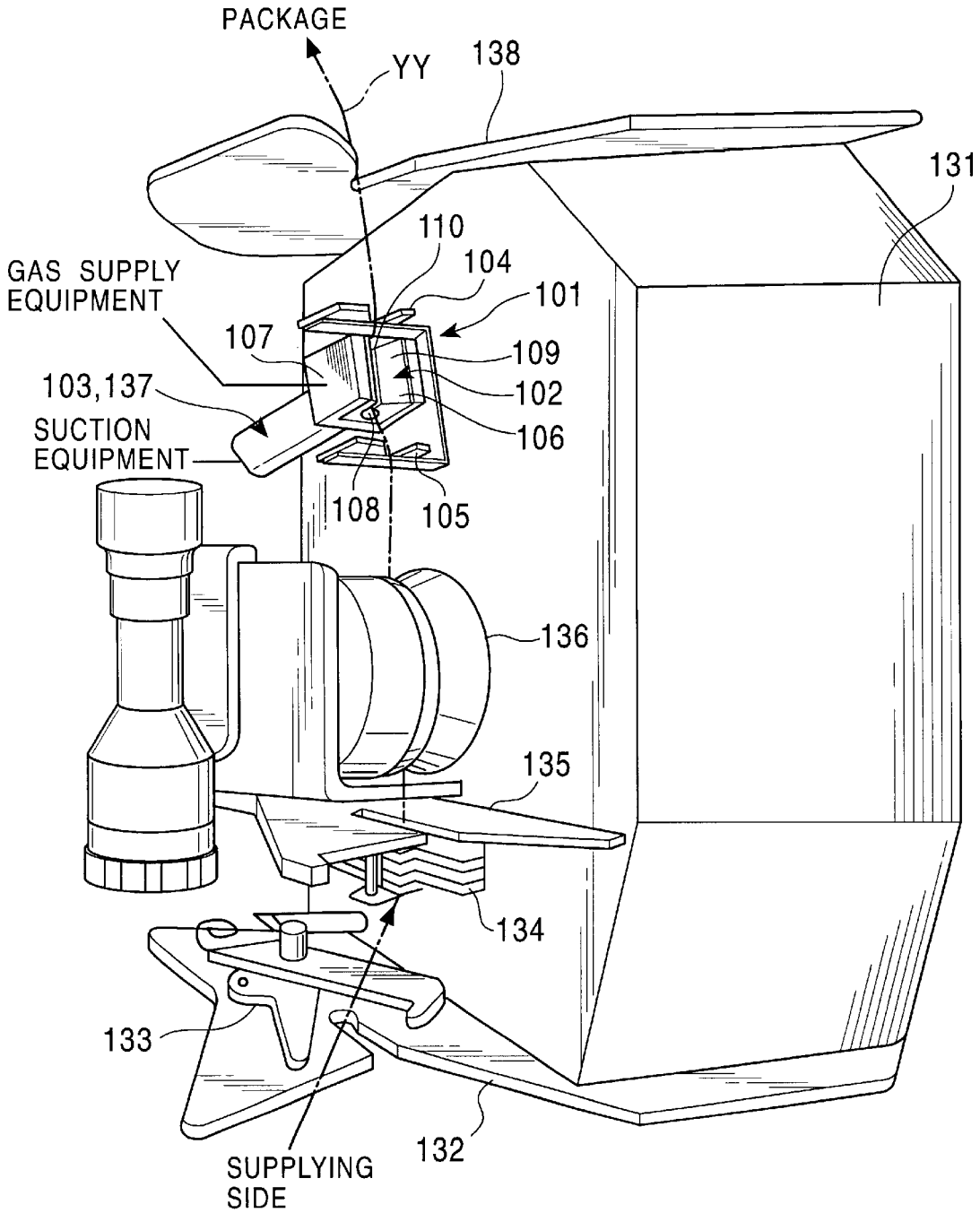
FIG. 6 is a perspective view showing a tenser box of a winder to which a hairiness suppressing device according to the second embodiment has been applied.

A hairiness suppressing device 101, which is shown in FIG. 6, is provided in a tenser box 131 of a winder (for example, an automatic winder). The tenser box 131 comprises a guide plate 132, a cutter 133, a gate feeler 134, a guide plate 135, a disc tenser 136, a yarn trap 137, and a guide plate 138 arranged in the order from a supplying side for a yarn YY (for example, a spun yarn comprising a collection of fibers) that runs to a package. The hairiness suppressing device 101 is provided in the yarn trap 137 in a yarn path. The yarn trap 137, which is shaped like a nozzle, sucks and captures the end of a broken yarn on the supplying side, and is connected to suction equipment (not shown in the drawings).

The hairiness suppressing device 101 comprises a whirling air current jet nozzle 102 (a jet nozzle means) for suppressing the generation of the hairinesses of the yarn YY, a suction nozzle 103 (a suction means) that sucks and removes dust or fluff from the yarn YY, and two yarn regulating plates 104, 105 that regulate the yarn YY. The yarn trap 137 of the tenser box 131 is also used as the suction means (the suction nozzle 103).

As shown in FIGS. 7 to 11, the integral whirling air current jet nozzle 102 is obtained by fitting a ceramics element 106 in a nozzle holder 107 having a recess cross section and tightening the element using bolts. The element 106 has formed therein a circular yarn passage 108 (a yarn passage hole) penetrating the element at its axis aa, and the yarn YY is introduced into the yarn passage 108 through a yarn introducing port 109 having a triangular opening and through a slit 110. The yarn introducing port 109 is formed parallel with and eccentrically to the axis aa of the yarn passage 108, and together with the slit 110, penetrates the element 106 in the axial direction (see FIGS. 8 and 9).

In addition, in the element 106, the yarn passage 108 has formed therein a plurality of jet holes 111 to 113 that jet a gas (air, humidified air, or steam) and a long suction hole 114 for sucking the inside of the yarn passage 108. Each of the jet holes 111 to 113 is formed around the yarn passage 108 except for the yarn introducing port 109 and a portion opposed to the yarn introducing port 109, and opens into the yarn passage 108 horizontally from the tangential direction of the inner circumference of the yarn passage 108. Of these jet holes 111 and 113, the jet holes 111 and 113 are located on one side of the yarn passage 108 and formed at each axial end, and are in communication with each other in a jet space 115. The remaining jet hole 112 is located on the other side of the yarn passage 108 and formed in the axial center of the element 106, and is in communication with a jet space 116. The jet spaces 115, 116 are each in communication with gas supply equipment (not shown in the drawings) via each jet port 117 of the nozzle holder 107 and each pipe connected to the nozzle holder 107 (see FIGS. 8 and 9).

On the other hand, the long suction hole 114 is open in such a way as to extend from a side opposed to the yarn introducing port 109 and to intersect the tangential direction of the inner circumference of the yarn passage 108. The long suction hole 114 penetrates the element 106 and then penetrates the nozzle holder 107 where the hole 114 has a larger diameter. The long suction hole 114 is formed between the jet holes 111 and 113 (see FIGS. 8 and 9).

Figure 10:
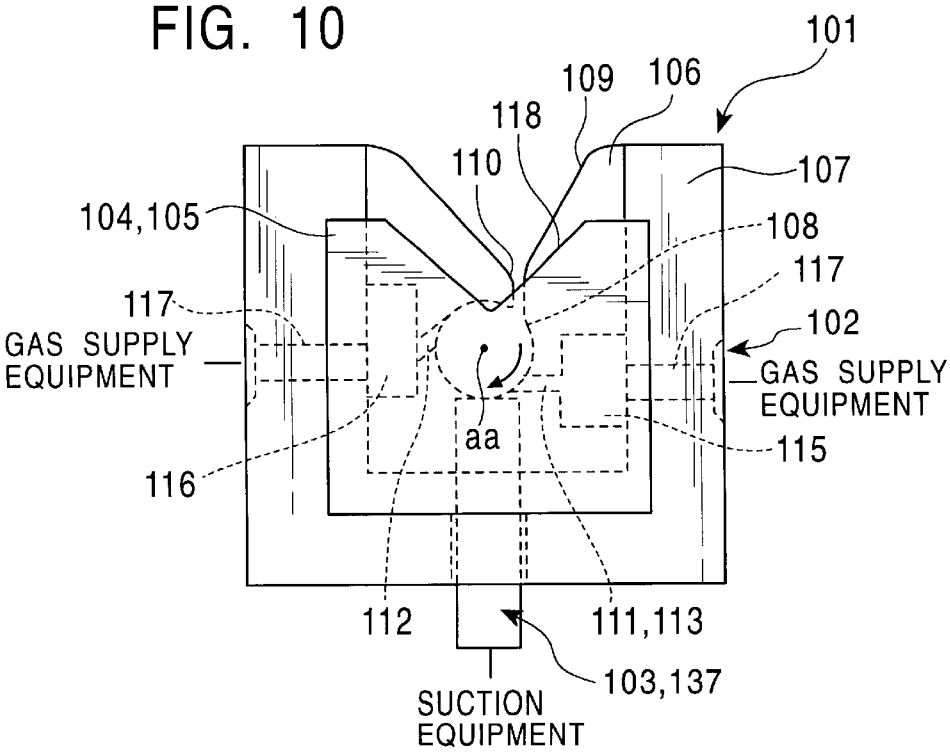
FIG. 10 is a different view of FIG. 7 as seen from the direction shown by arrow C.
Figure 11:
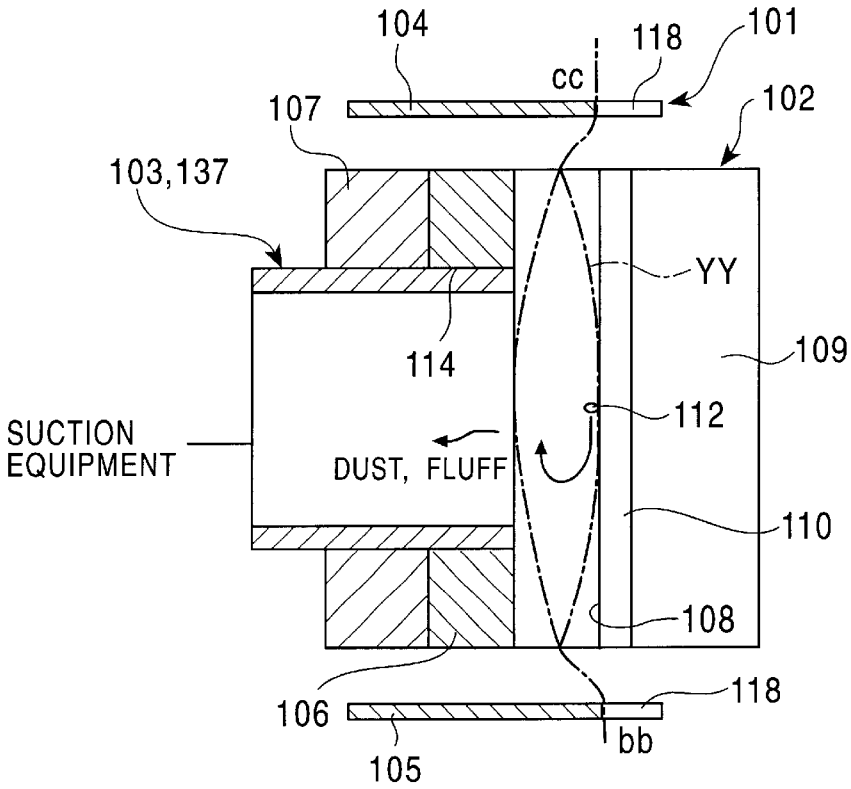
FIG. 11 is a sectional view taken along line XI—XI in FIG. 7.

The yarn regulating plates 104, 105 are each provided at each axial end of the element 106. The yarn regulating plates 104, 105 overlap each other in such a way as to cover each opening in the yarn passage 108 and has a V-shaped guide groove 118 that guides the yarn YY, as shown in FIG. 10. The yarn regulating plates 104, 105 acts as a guide for ballooning using a whirling air current acting on the yarn YY by regulating the yarn YY introduced into the yarn passage 108 in such a way as to bend it at fulcrums cc, bb of the guide groove 118, as shown in FIG. 11.

Figure 7:
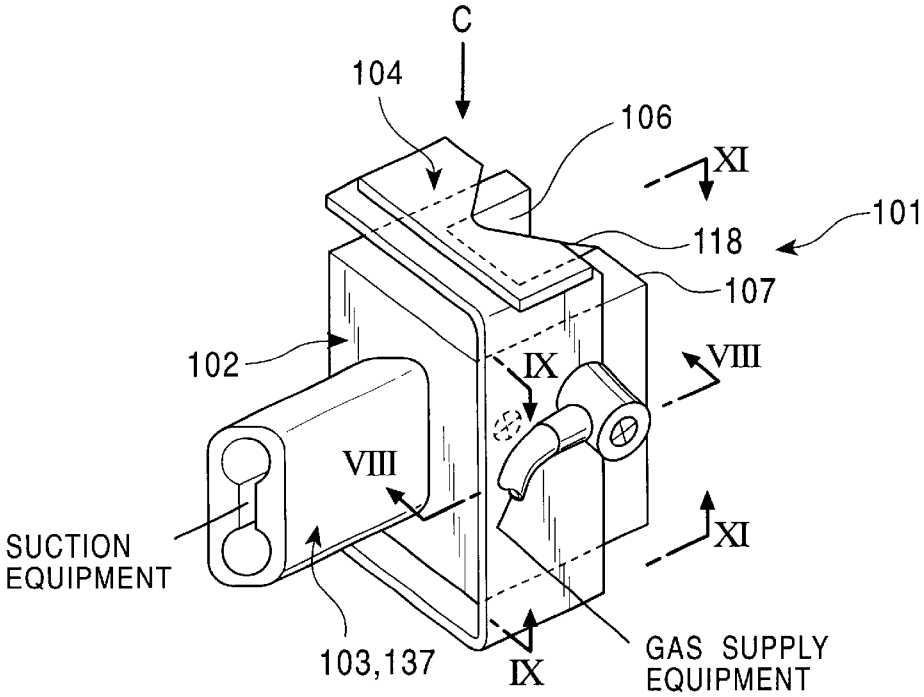
FIG. 7 is a perspective view showing the hairiness suppressing device in FIG. 6.
Figure 8:
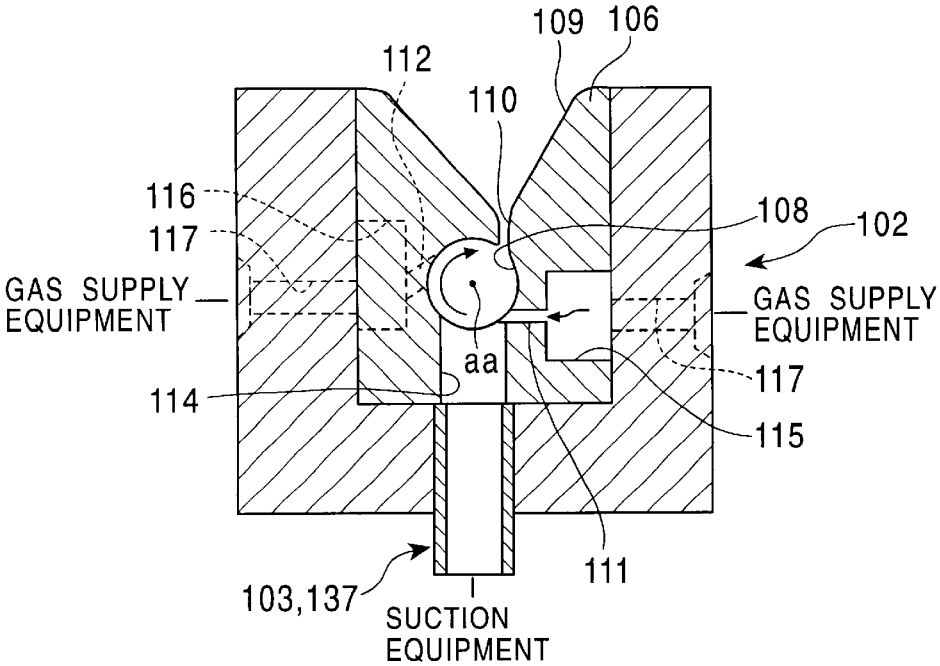
FIG. 8 is a sectional view taken along line VIII—VIII in FIG. 7.
Figure 9:
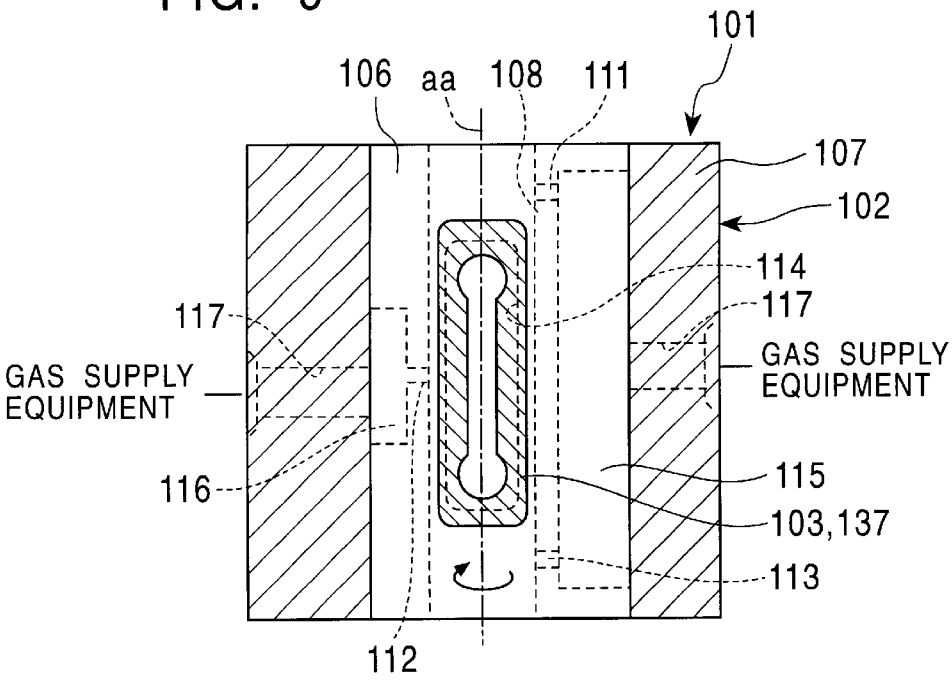
FIG. 9 is a sectional view taken along line IX—IX in FIG. 7.

According to the hairiness suppressing device 101 configured as described above, by inserting the yarn trap 137 into the long suction hole 114 in the whirling air current jet nozzle 102 until the yarn trap 137 abuts on the element 106, the whirling air current jet nozzle 102 is provided in the yarn trap 137 to enable the inside of the yarn passage 108 to be sucked (see FIGS. 7 to 9).

Next, an operation of the hairiness suppressing device 101 is described.

A gas from the air supply equipment (not shown in the drawings) is jetted into the yarn passage 108 from each of the jet holes 111 to 113 through each of the jet ports 117 and each of the jet spaces 115, 116. At this point, the gas is jetted from each of the jet holes 111 to 113 in the tangential direction of the inner circumferential surface of the yarn passage 108 to cause a whirling air current in the yarn passage 108 (see FIGS. 8 and 9).

The whirling air current occurring in the yarn passage 108 balloons (swivels) the yarn YY in such a way that it slides along the inner circumferential surface of the yarn passage YY using the yarn regulating plates 104, 105 as fulcrums, thereby false-twisting the yarn. When the yarn is false-twisted in this manner, the yarn YY comes in contact with the guide grooves 118 in the yarn regulating plates 104, 105 while rotating. Accordingly, the hairiness suppressing processing is carried out that entangles hairinesses with the fiber of the yarn for suppressing to restrain further hairinesses (see FIG. 11).

In addition to air and humidified air, steam can be used as a gas for ballooning (whirling) the yarn YY. In particular, both the yarn YY passing through the yarn passage 108 and the inner circumferential surface of the yarn passage 108 can be heated using steam. The steam also enables the hairinesses (fibers) on the yarn YY to be softened. Thus, the yarn YY, which is ballooned in such a way as to slide through the yarn passage 108, enables its hairinesses that have been softened by false-twisting to be effectively entangled with and caught in the fibers, while due to contact with the inner circumferential surface of the yarn passage 108, the yarn YY is heat-set as if it was ironed, thereby maintaining a form with a reduced number of hairinesses.

In addition, simultaneously with the jetting of the gas from each of the jet holes 111 to 113, the yarn trap 137 starts suction. The yarn trap 137 provides such a suction force as not disturb the whirling air current in the yarn passage 108 or not suck the ballooned (whirled) yarn YY. Thus, the yarn trap 137 can suck and remove dust or fluff leaving the yarn YY due to the whirling air current occurring in the yarn passage 108 and the ballooning of the yarn YY or can directly suck and remove dust or fluff from the yarn YY passing through the long suction hole 114 (see FIG. 11).

Although the hairiness suppressing device 101 according to the present invention has been shown in conjunction with the yarn trap 137 of the tenser box 131 also used as the suction means, the suction means may be formed, for example, between the cutter 133 and the gate feeler 134. In this case, the long suction hole 114 in the whirling air current jet nozzle 102 must be directly connected to the suction equipment via piping.

Figure 12:
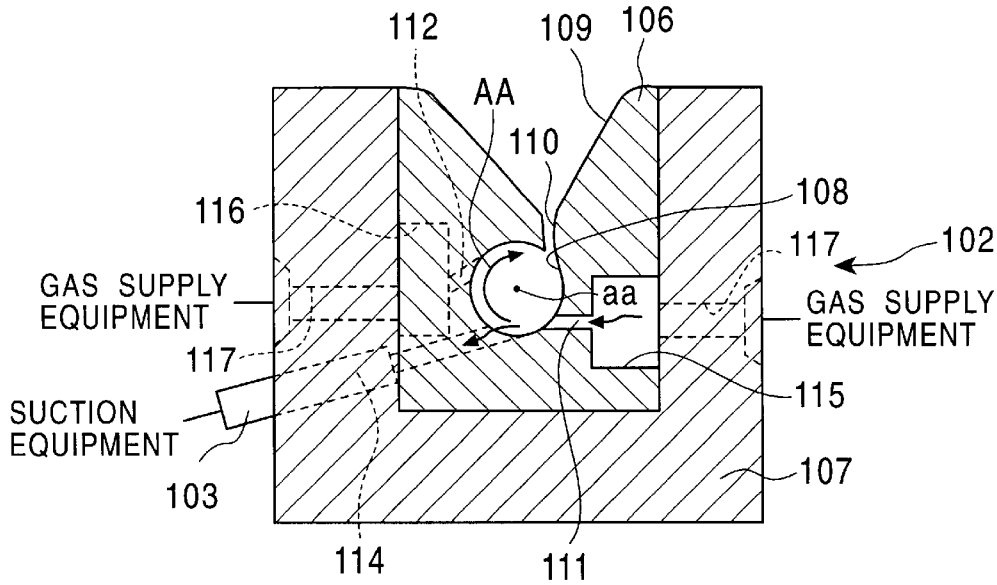
FIG. 12 is a sectional view showing a variation of the hairiness suppressing device according to the second embodiment.

In addition, although the hairiness suppressing device 101 in FIGS. 6 to 11 has been shown in conjunction with the long suction hole 114 intersecting the tangential direction of the inner circumferential surface of the yarn passage 108, the long suction hole 114 may be formed in the tangential direction of the inner circumferential surface of the yarn passage 108 so as to open into the yarn passage 108, as shown in FIG. 12. In this case, the long suction hole 114 opens into the yarn passage 108 in such a way as to be opposed to a whirling direction AA of the whirling air current. Even if the suction nozzle 103 inserted into the long suction hole 114 is used to suck the inside of the yarn passage 108, this configuration can efficiently suck and reliably remove dust or fluff leaving the yarn and flowing along the inner circumferential surface of the yarn passage 108 due to the swiveling force (centrifugal force) of the whirling air current or can directly suck and remove dust or fluff from the yarn YY in the same manner, without disturbing the whirling air current (the ballooning of the yarn YY) in the yarn passage 108.

Next, an example in which the hairiness suppressing device 101 has been applied to an automatic winder (a winder) is explained with reference to FIG. 13.

Figure 13:
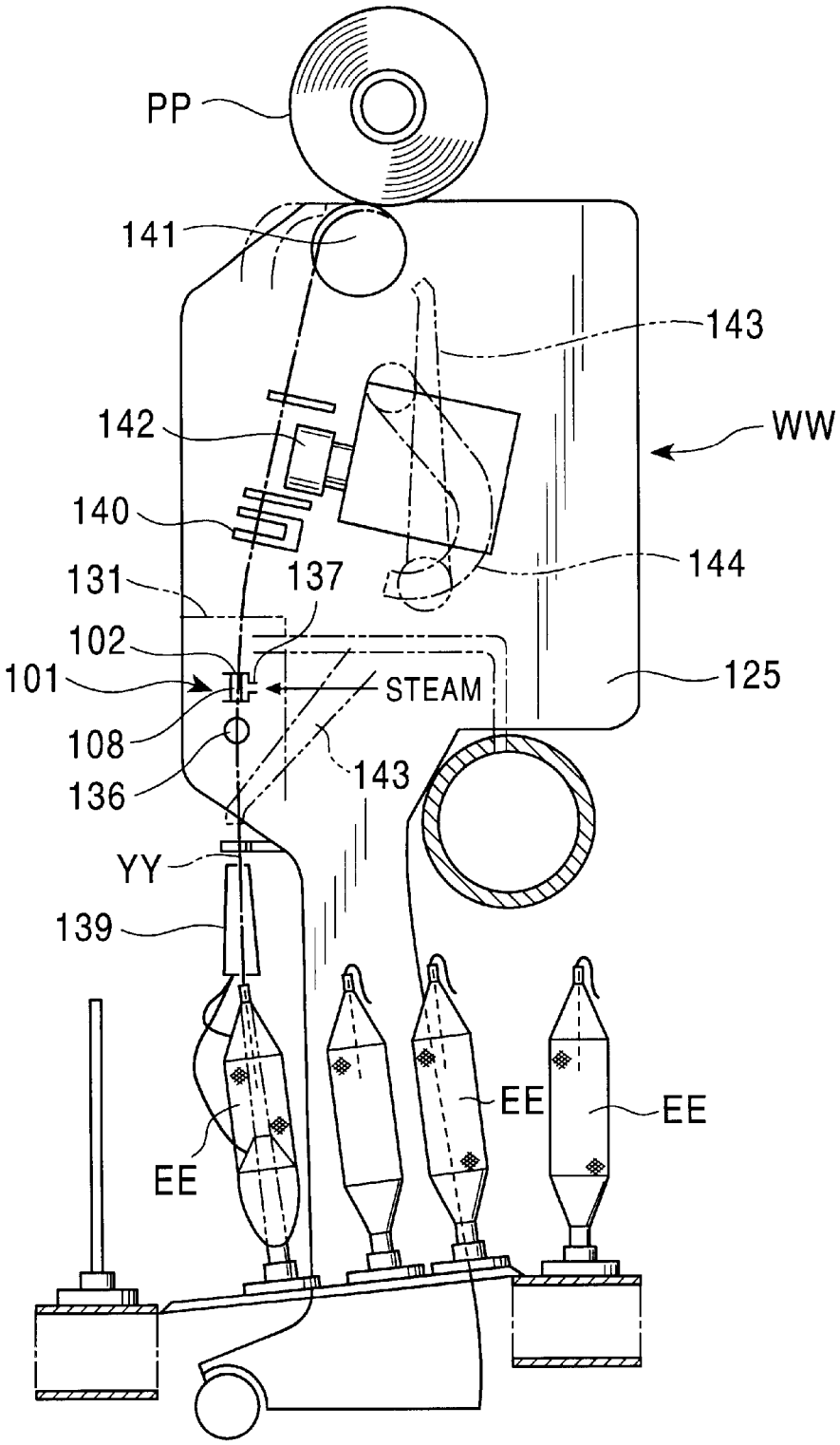
FIG. 13 shows the arrangement of an automatic winder to which the hairiness suppressing device according to the second embodiment has been applied.
Figure 14:
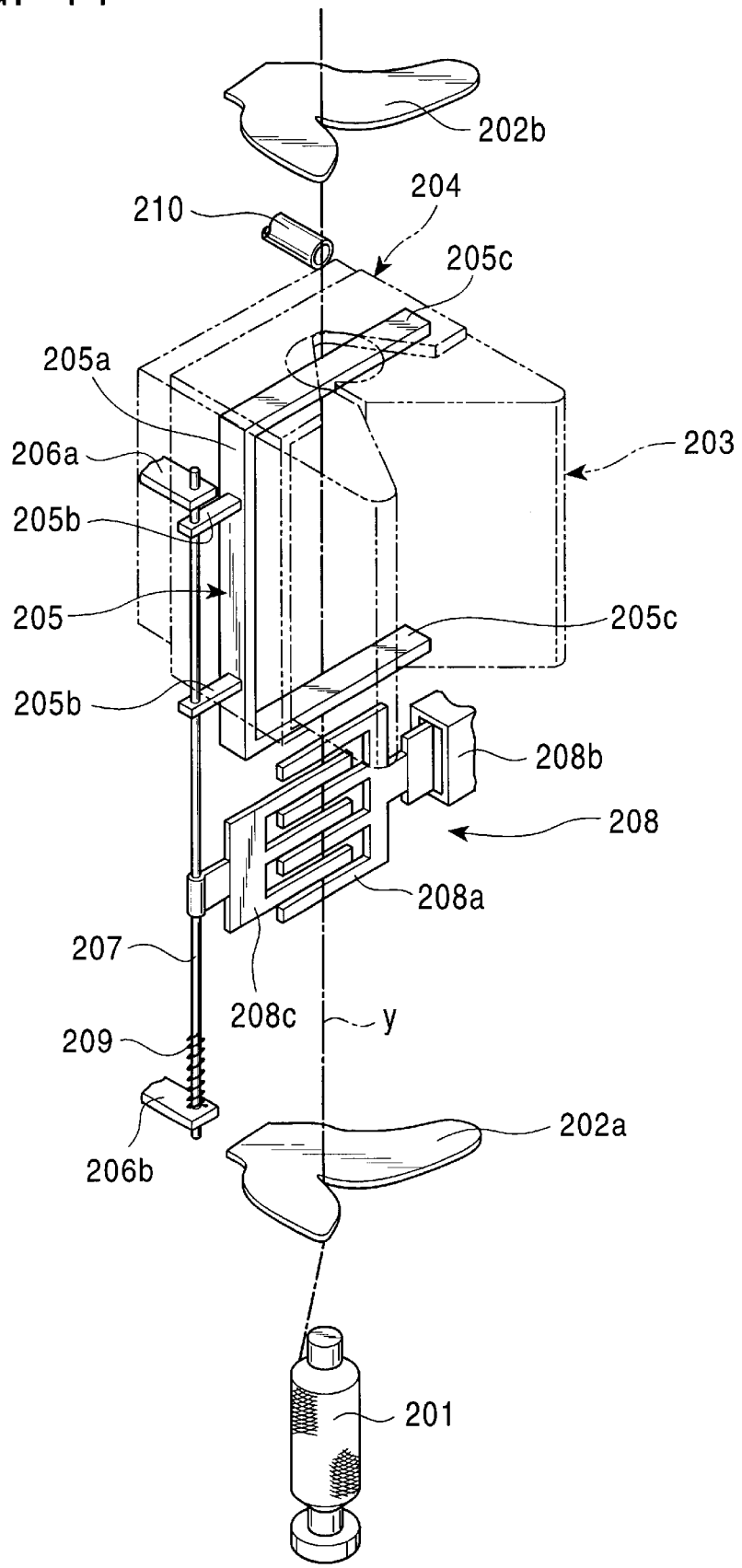
FIG. 14 is a partly perspective view of a yarn rewinding device to which a yarn processing method according to the present invention is applied.
Figure 15:
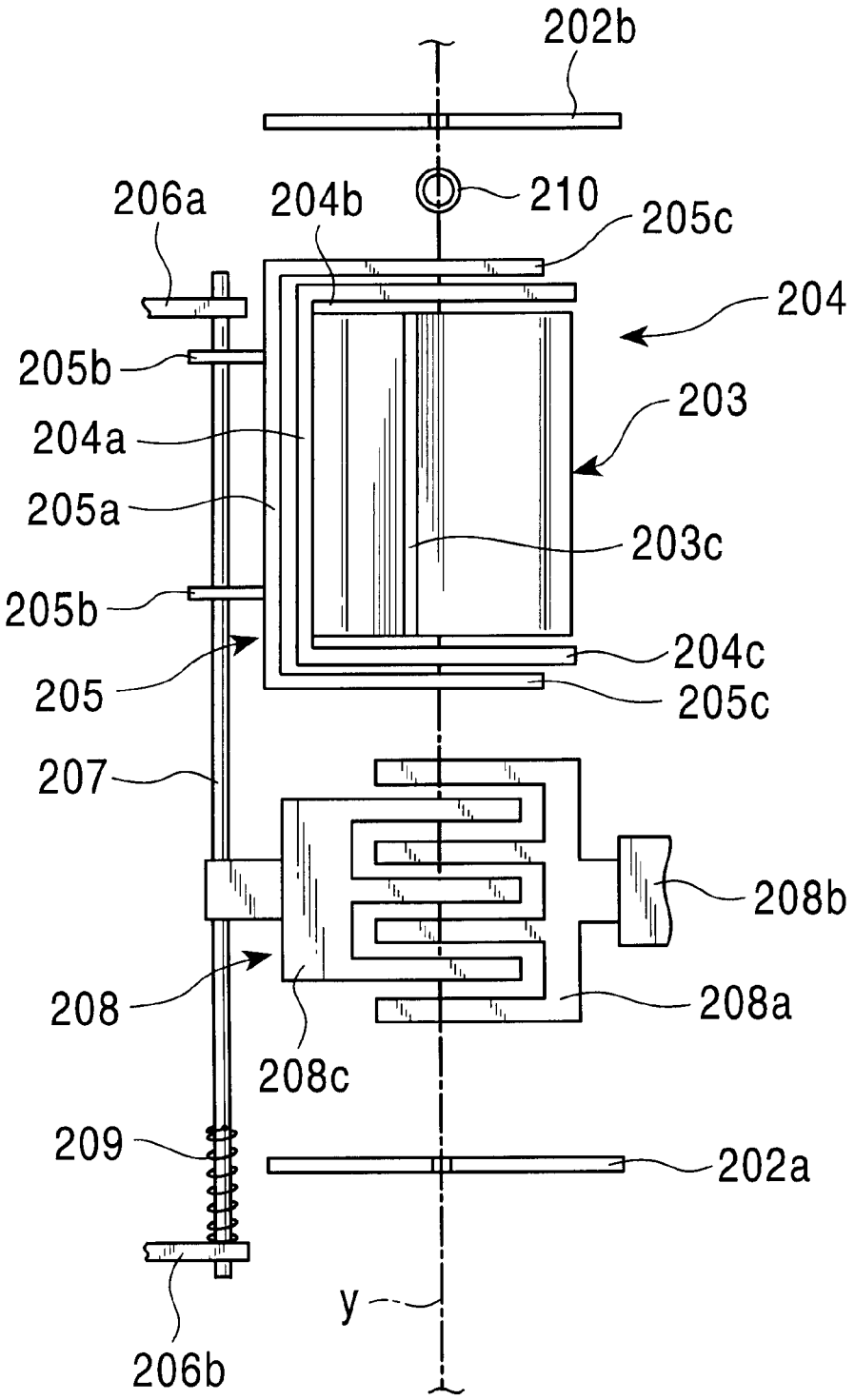
FIG. 15 is a front view of FIG. 14.
Figure 16A:
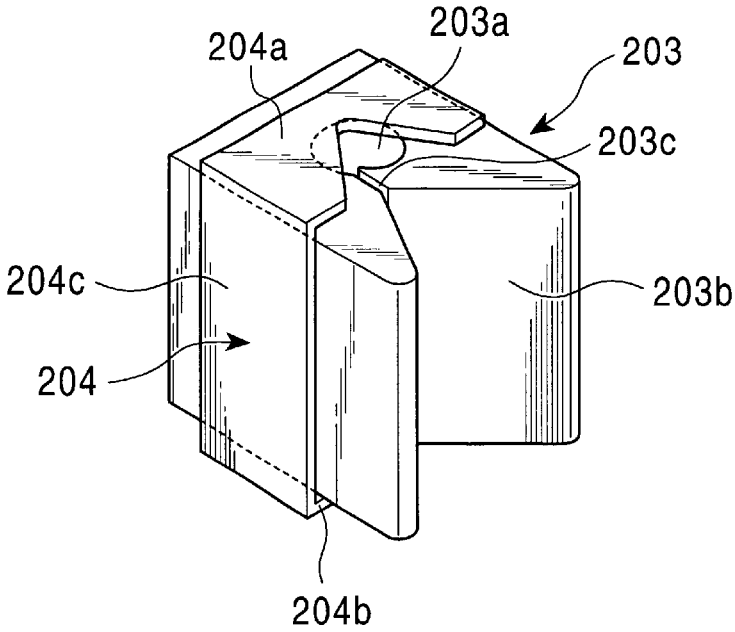
FIG. 16A is a perspective view of a whirling air current generation member and FIG. 16B is a fixed guide member constituting a yarn processing device, that is a hairiness suppressing device of the third embodiment, according to the present invention.
Figure 16B:
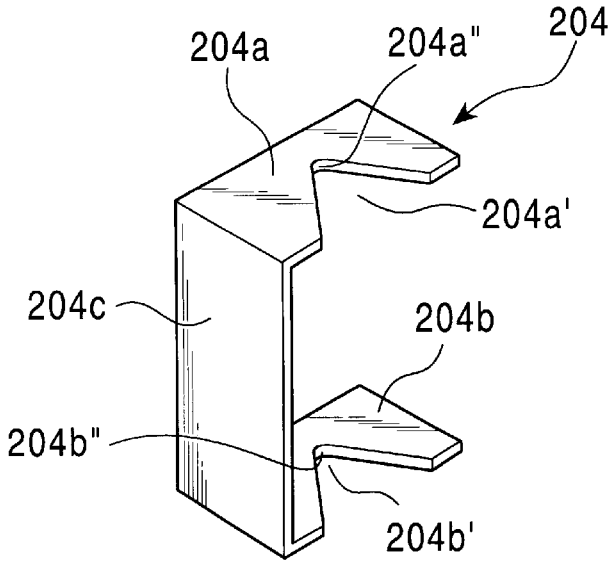

An automatic winder WW, which is shown in FIG. 13, comprises a large number of winding units installed in a line, and each winding unit 125 comprises a tenser box 131 in FIG. 6 (including the hairiness suppressing device 101). Each winding unit 125 threads the spun yarn YY unwound from a supplying bobbin EE supplied at a predetermined position, through a balloon breaker 139, a tenser 136 and the hairiness suppressing device 101 of the tenser box 131, and a slab catcher 140 that detects a defect in the yarn YY, and then winding the yarn around a package PP rotated by a traverse drum 141. 142 is a yarn splicing device, 143 is a suction mouth that guides the yarn end on the package PP side to the yarn splicing device 142, and 144 is a relay pipe that guides to the yarn splicing device 142, the yarn end on the supplying bobbin EE sucked and captured by the yarn trap 137.

When the traverse drum 141 of each winding unit 125 is driven to start rewinding (winding) the yarn YY, the yarn YY is unwound from the supplying bobbin EE and subjected to the hairiness suppressing processing that uses a whirling current from the whirling air current jet nozzle 102 to balloon and false-twist the yarn while it is passing through the hairiness suppressing device 101. At the same time, the yarn trap 137 can suck and remove dust or fluff leaving the yarn Y, thereby enabling the yarn to be subjected to the hairiness suppressing processing in a clean state. In particular, this operation is significantly effective on a spun yarn comprising a collection of fibers, enabling reliable hairiness suppressing processing and the reliable removal of fluff or dust from the yarn.

If the yarn YY is broken while being wound around the package PP, the yarn YY must be spliced. In this case, the jetting of a gas from the whirling air current jet nozzle 102 of the hairiness suppressing device 101 is stopped, and an extra yarn end on the supplying bobbin EE side is sucked and captured by the yarn trap 137. The relay pipe 144 is swivelled to the neighborhood of the balloon breaker 139 to suck the end of the yarn captured by the yarn trap 137 and then to guide it to the yarn splicing device 142. At this point, the yarn YY is threaded through each of the members 132 to 135 and tenser 136 of the tenser box 131 and then threaded through the yarn passage 108 of the hairiness suppressing device 101 via the yarn introducing port 109 and the slit 110. Subsequently, the suction mouth 143 sucks the yarn end on the package PP side to guide it to the yarn splicing device 142, which then splices the yarn YY.

Accordingly, the yarn trap 137 can also be used as the suction means for the hairiness suppressing device 101 without hindering the conventional functions of the yarn trap 137.

Although the example in which the hairiness suppressing device 101 has been applied to the automatic winder WW has been shown, it may be applied to a winder such as a doubling and twisting machine or a warper.

An embodiment of the present invention for achieving the third object is described below, but the present invention is not limited to this embodiment unless its original idea is included.

Figure 17:
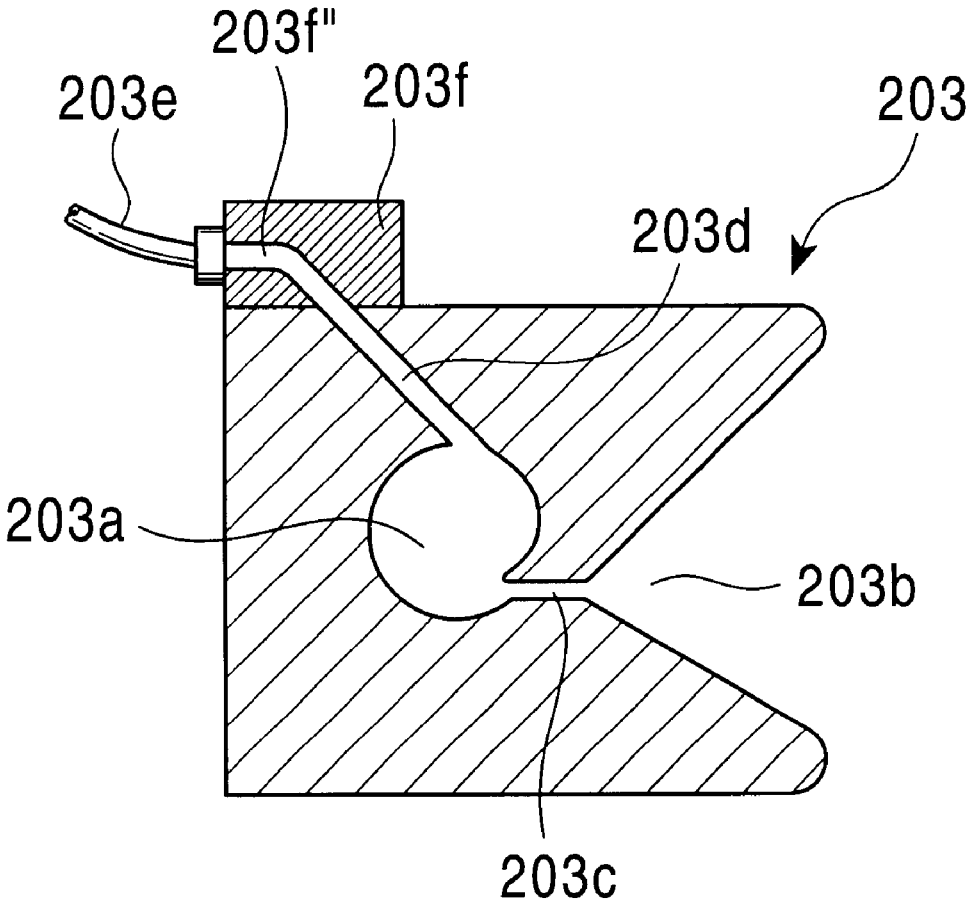
FIG. 17 is a horizontal sectional view showing the neighborhood of the center of the whirling air current generation member of the yarn processing device according to the present invention.

In FIGS. 14 to 17, 201 is a supplying package (supplying bobbin), and a spun yarn y rewound from a supplying package 201 is wound around a winding package (not shown in the drawings). 202*a*, 202*b* are yarn guides approximately Y-shaped in a top view, placed above the supplying package 201, and spaced at a predetermined interval. 203 is a whirling air current generation member shaped approximately line a prism and disposed between the yarn guides 202*a*, 202*b*. The whirling air current generation member 203 has a vertical hole 203*a* is formed at its center, and has on one side, a recess section 203*b* shaped like a triangle in a top view and enlarging toward the side wall. The whirling air current generation member 203 also has formed therein a slit 203*c* that connects the triangular recess section 203*b* and the vertical hole 203*a* together and through which a yarn can be inserted to pass. The vertical hole 203*a* has machined approximately at its center, an air jet hole 203*d* opening in a tangential direction of the inner circumferential surface of the vertical hole 203*a*. FIG. 17 shows an example in which one air jet hole 203*d* is machined, but a plurality of air jet holes 203*d* may be provided in the tangential direction of the inner circumferential surface of the vertical hole 203*a*. 203*e* is a pipe attached to one side surface of the whirling air current generation member 203 to supply compressed air to the air jet hole 203*d* via a block 203*f* having a transparent hole 203*f'* in communication with the air jet hole 203*d*. When air is jetted in the tangential direction of the inner circumferential surface of the vertical hole 203*a* from the air jet hole 203*d* via the pipe 203*e* and the block 203*f*, a whirling air current can be generated in the whirling air current generation member 203.

204 is a fixed guide member mounted on one side surface of the whirling air current generation member 203. The fixed guide member 204 comprises a vertical section 204*c* mounted on the one side surface of the whirling air current generation member 203 and horizontal sections 204*a*, 204*b* extending horizontally from the upper and lower ends of the vertical wall 204*c*. Recess sections 204*a*', 204*b*' each shaped like a triangle in a top view are formed in the horizontal sections 204*a*, 204*b* in the same orientation as the recess section 203*b*. The fixed guide member 204 is mounted on the whirling air current generation member 203 so that the bottom 204*a*", 204*b*" of the triangular recess section 204*a*', 204*b*' of the fixed guide member 204 is located approximately at the center of the vertical hole 203*a* in the whirling air current generation member 203.

205 is a movable guide member having an approximate turned-sideways U-shape in a front view and disposed outside the fixed guide member 204, and horizontal plates 205*b* attached to a vertical section 205*a* of the movable guide member 205 are fitted on a vertical rod 207 rotatably supported by support plates 206*a*, 206*b* attached to an appropriate frame. Horizontal sections 205*c* are formed to extend horizontally from the upper and lower ends of the vertical section 205*a*.

208 is a gate tension member provided as an example of a tension applying device disposed between the lower yarn guide 202*a* and the movable guide member 205. A fixed section 208*a* of the gate tension member 208 is attached to an appropriate frame 208*b*, and a movable section 208*c* of the gate tension member 208 is attached to the vertical rod 207.

209 is a coil spring having a lower end engagingly locked to the lower support plate 206*b* and an upper end engagingly locked to the vertical rod 207, and is adapted to urge the rod toward the fixed guide member 204, the horizontal section 205*c* of the movable guide member 205 attached to the vertical rod 207, while urging the movable section 208*c* of the gate tension member 208 toward the fixed section 208*a*. 210 is a yarn trap comprising a suction pipe.

To thread the yarn y drawn upward from the supplying package 201, through the gate tension member 208 and the whirling air current generation member 203, the movable guide member 205 or the movable section 208*c* of the gate tension member 208 is rotationally moved away from the fixed guide member 204 or the fixed section 208*a* of the gate tension member 208 around the vertical rod 207 against the urging force of the coil spring 209. Consequently, the movable guide member 205 is withdrawn so as not to obstruct the introduction of the yarn y into the vertical hole 203*a* in the whirling air current generation member 203 and the recess sections 204*a*, 204*b* in the fixed guide member 204, while the movable section 208*c* is separated from the fixed section 208*a* of the gate tension member 208 so that the yarn y can abut on the fixed section 208*a*.

Then, the yarn y drawn upward from the supplying package 201 is placed on the fixed section 208*a* of the gate tension member 208 and then in the vertical hole 203*a* in the whirling air current generation member 203 through its slit 303*c*. Subsequently, the urging force of the coil spring 209 rotationally moves the withdrawn movable guide member 205 toward the fixed guide member 204, and the fixed guide member 204 and the movable guide member 205 sandwich the yarn y so as to allow the yarn y introduced into the recess sections 204*a* ', 204*b* ' of the fixed member 204 to be placed at the bottom 204*a* ", 204*b* " of the recess sections 204*a* ', 204*b* ' located approximately at the center of the vertical hole 203*a* in the whirling air current generation member 203. In addition, the movable section 208*c* of the gate tension member 208 presses the yarn y located at the fixed section 208*a* so that the gate tension member 208 applies an appropriate tension to the yarn y. In this manner, the yarn y drawn upward from the supplying package 201 is wound around a winding package (not shown in the drawings) via the lower yarn guide 202*a*, the gate tension member 208, the whirling air current generation member 203 with the fixed guide member 204 and movable guide member 205 disposed above and below it, and the upper yarn guide 202*b*. Although the yarn y is sandwiched between the fixed guide member 204 and the movable guide member 205 above and below the whirling air current generation member 203, as described above, the sandwiching force applied to the yarn y by the fixed guide member 204 and the movable guide member 205 naturally has such a magnitude as to not obstruct the running of the yarn y or damage the yarn y.

The yarn y sandwiched between the fixed guide member 204 and the movable guide member 205 above and below the whirling air current generation member 203 so as to be located approximately at the center of the vertical hole 203*a* in the whirling air current generation member 203 is then ballooned by a whirling air current in the vertical hole 203*a* in the whirling air current generation member 203, between the points at which it is sandwiched between the fixed guide member 204 and the movable guide member 205. The balloon formed by the whirling air current is large because the points at which the yarn y is sandwiched between the fixed guide member 204 and the movable guide member 205 are located approximately at the center of the vertical hole 203*a* in the whirling-air current generation member 203. Thus, hairiness suppressing processing is carried out that uses the whirling air current and the ballooning to effectively remove fluffs or dust simply adhering to the yarn y and that suppresses hairinesses protruding from the surface of the yarn y, to the surface of the yarn y in order to reduce the hairinesses.

In addition, if the yarn y has a weak portion, when it is swung by the ballooning, it is broken or severed at the weak portion. The yarn y severed at the weak portion is then spliced by a splicing device, such as a knotter or a splicer (not shown in the drawings). In this manner, since the weak portion can be removed beforehand during the rewinding step, this configuration can prevent a yarn broken at a weak portion leading to the degradation of the working efficiency of a subsequent step such as a warping step. As a result, the working efficiency of the subsequent step, such as a warping step, is improved.

The above embodiment has been shown in conjunction with the example in which the means for holding the yarn y approximately at the center of the vertical hole 203*a* in the whirling air current generation member 203 is composed of the fixed guide member 204 disposed at the inlet and outlet gates of the whirling air current generation member 203 and the movable guide member 205 that is urged toward the fixed guide member 204. A yarn guide such as an eyelet guide or a wire guide that holds the yarn y approximately at the center of the vertical hole 203*a* in the whirling air current generation member 203 may be disposed at the inlet and outlet gates of the whirling air current generation member 203 to hold the yarn y approximately at the center of the vertical hole 203*a* in the whirling air current generation member 203. When, however, the means for holding the yarn y approximately at the center of the vertical hole 203*a* in the whirling air current generation member 203 is composed of the fixed guide member 204 disposed at the inlet and outlet gates of the whirling air current generation member 203 and the movable guide member 205 that is urged toward the fixed guide member 205, the movable guide member 205 can be rotationally moved away from the fixed guide member 204 to withdraw so as not to obstruct the introduction of the yarn y into the vertical hole 203*a* in the whirling air current generation member 203, thereby facilitating the insertion of the yarn y into the vertical hole 203*a* of the whirling air current generation member 203.

As described above, since the movable guide member 205 and the movable section 208*c* of the gate tension member 208 are both attached to the vertical rod 207, the vertical rod 207 can be rotated to rotationally move the movable guide member 205 and the movable section 208*c* of the gate tension member 208 at the same time. This configuration can promptly and easily finish setting the yarn y approximately at the center of the vertical hole 203*a* in the whirling air current generation member 203 and sandwiching the yarn y between the components of the gate tension member 208.

Figure 18:
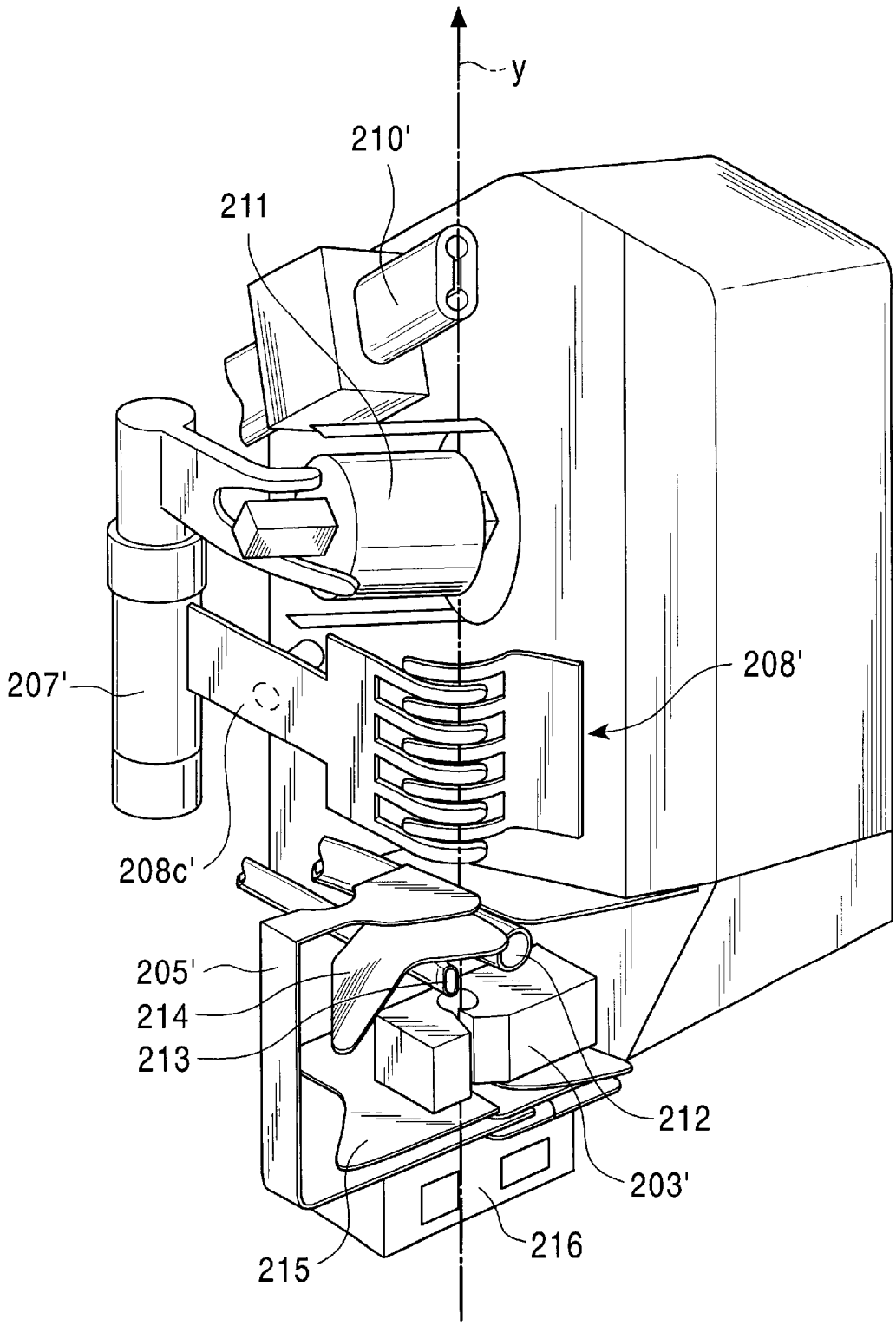
FIG. 18 is a partly perspective view of a rewinding device according to another embodiment to which the yarn processing method according to the present invention is applied.

According to the embodiment shown in FIG. 18, a whirling air current generation member 203' similar to the whirling air current generation member 203 is placed below a gate tension member 208' similar to the gate tension member 208. 211 is a cylindrical wax member attached to a vertical rod 207' similar to the vertical rod 207 to apply wax to the yarn y. 205' is a movable guide member similar to the movable guide member 205, 212 is a suction nozzle for sucking hairinesses severed by ballooning the yarn y in order to prevent hairinesses from splashing, and 213 is an air blast nozzle for cleaning that jets air. 214, 215 are fixed guides that guide the yarn y, and 216 is a photoelectric sensor for detecting a lower yarn. In this manner, the positions at which the whirling air current generation member 203 and the movable guide member 205 are placed are not limited to the above embodiment.

Figure 19:
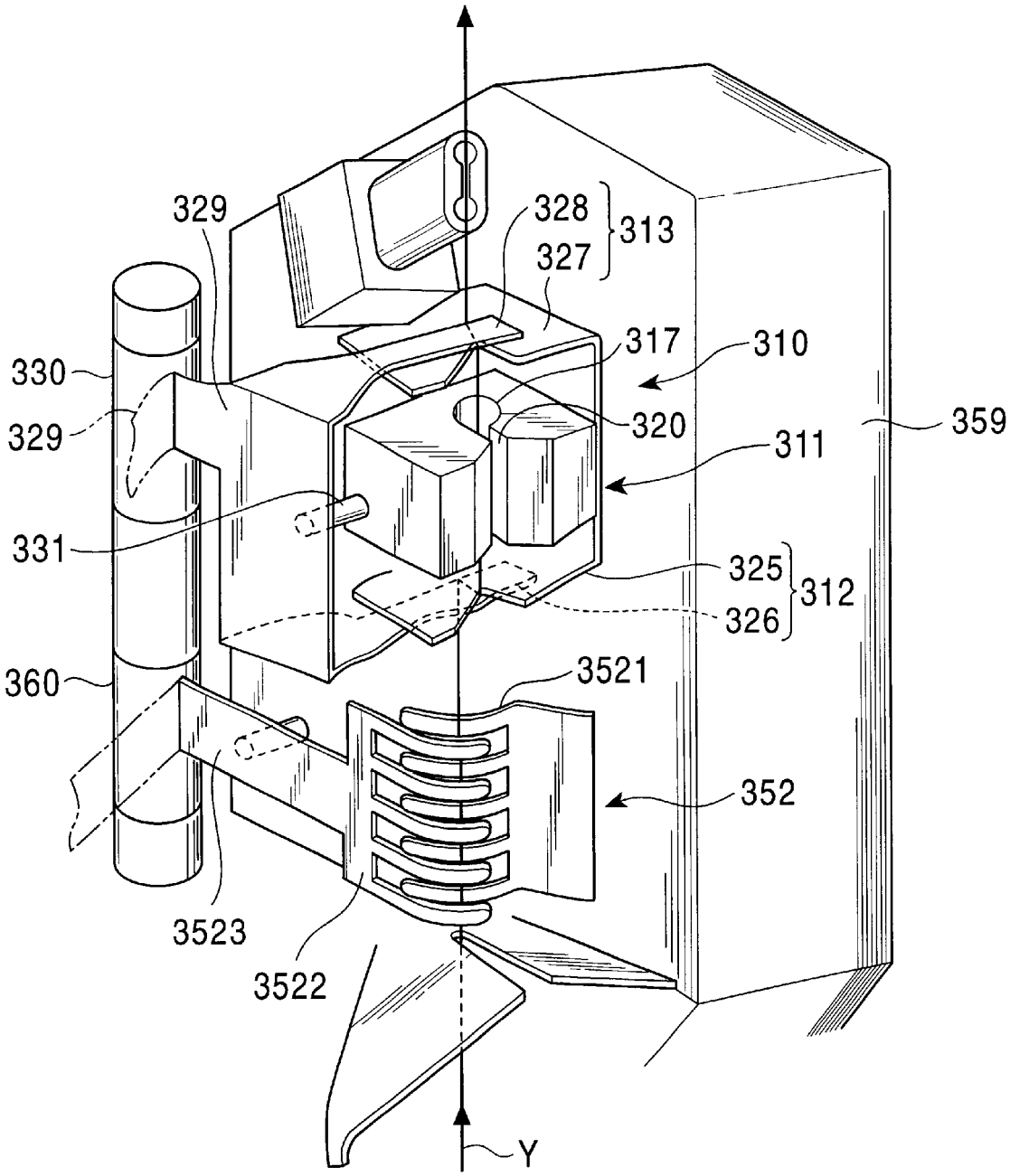
FIG. 19 is a perspective view of essential parts of an automatic winder in which a hairiness suppressing device is installed according to a fourth embodiment.
Figure 20:
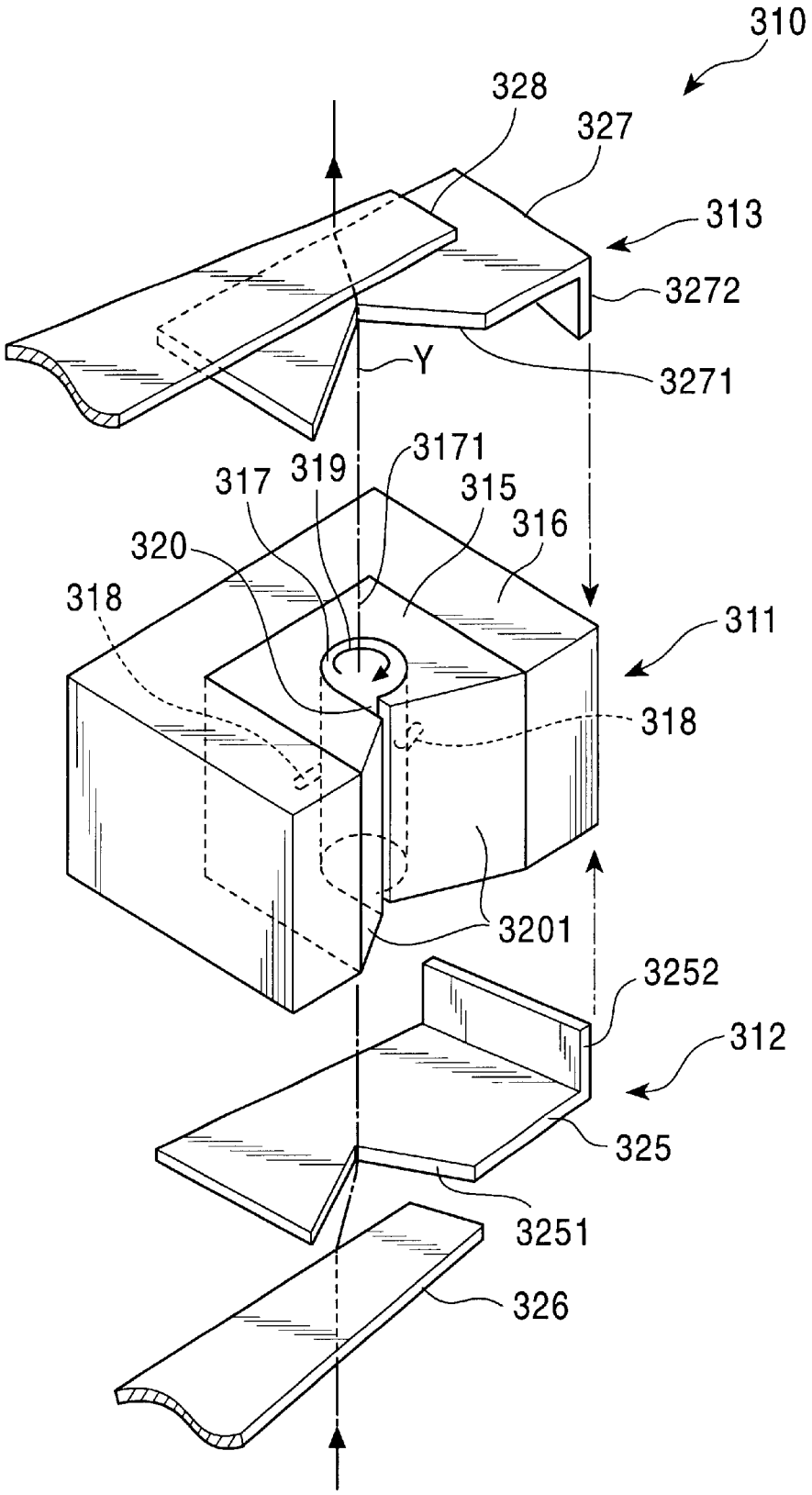
FIG. 20 is a perspective view showing that the hairiness suppressing device in FIG. 19 is decomposed.
Figure 21:
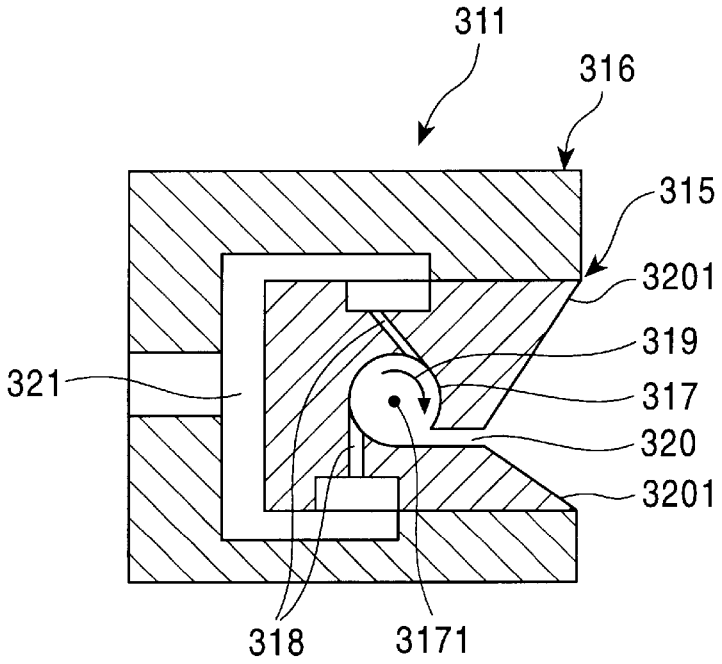
FIG. 21 is a sectional view of a nozzle means of the hairiness suppressing device in FIG. 19.
Figure 22:
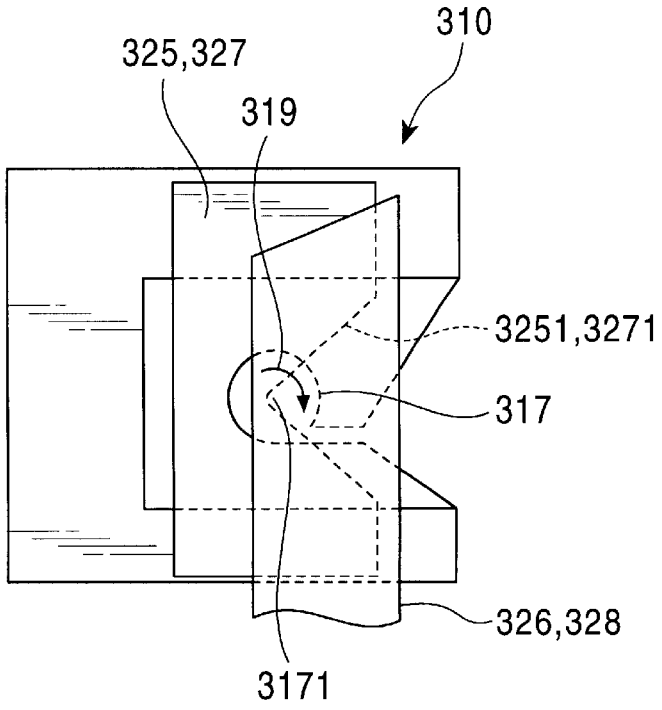
FIG. 22 is a top view of the hairiness suppressing device in FIG. 19.

A fourth embodiment for achieving the fourth object will be described below with reference to the drawings. FIG. 19 is a perspective view of essential parts of an automatic winder 301 in which a hairiness suppressing device 310 is installed. FIG. 20 is a perspective view showing that the hairiness suppressing device 310 in FIG. 19 is decomposed. FIG. 21 is a sectional view of nozzle means 311 of the hairiness suppressing device 310. FIG. 22 is a top view of the hairiness suppressing device 310.

In FIGS. 19 and 20, the hairiness suppressing device 310 comprises central nozzle means 311, a twisting stop means 312 provided at the inlet side of the nozzle means 311, and twisting stop means 313 provided at the outlet side of the nozzle means 311.

In FIGS. 20 and 21, the nozzle means 311 comprises a body 315 made of ceramics and a holder 316 in which the body 315 is fitted. The body 315 has a yarn passage 317 formed as a through-hole having a circular cross section, and a gas-jetting hole 318 that opens approximately in the middle of the yarn passage in the direction of a central axis 3171 and that extends in a tangential direction of the circular cross section of the yarn passage 317. Two or more gas-jetting holes 318 are preferably provided as shown in the drawings. By jetting a compressed gas from the gas-jetting hole 318, a whirling current 319 is formed along the circumference of the cross section of the yarn passage 317. Compressed air is normally jetted from the gas-jetting hole 318.

The yarn passage 317 has a slit like opening 320 extending in a direction along the central axis 3171 thereof. Since the opening 320 is open in a tangential direction reverse to the direction of the whirling current 319, the spun yarn Y ballooned by the whirling current 319 is prevented from jumping out from the opening 320. In addition, because of an inclined surface 3201 formed after the opening 320 in such a way as to extend like a fan, the yarn Y, which has passed the inclined surface 3201, is reliably inserted into the yarn passage 317 through the opening 320. In addition, as clearly shown in FIG. 21, a gas passage 321 reaching the gas-jetting hole 318 is formed in the body 315 and the holder 316 as appropriate.

In FIG. 20, the twisting stop means 312 at the inlet side comprises a first guide member 325 and a second guide member 326 that are provided close to the inlet of the yarn passage 317. Like the twisting stop means 312 at the inlet side, the twisting stop means 313 at the outlet side comprises a first guide member 327 and a second guide member 328 that are provided close to the outlet of the yarn passage 317. Part of the first guide members 325, 327 and second guide members 326, 328 that is in contact with the yarn Y is formed of ceramics.

The first guide members 325, 327 are disposed closer to the inlet or outlet of the yarn passage 317 and are fixed to predetermined positions above or below the holder 317 by means of bent sections 3252, 3272. In addition, the first guide members 325, 327 have V-shaped recess sections 3251, 3271, respectively, that open toward the opening 320. As shown in FIG. 22, the bottom of the recess sections 3251, 3271 is located near the central axis 3171 of (in the center of ) the yarn passage 317.

The second guide members 326, 328 are plate, and are placed farther from the inlet or outlet of the yarn passage 317 and at a predetermined distance from the first guide members 325, 327, respectively. As shown in FIG. 19, the second guide members 326, 328 are integrally fixed to a lever 329. The lever 329 can be swivellably moved around a shaft 330. When the second guide members 326, 328 are placed at operating operations as shown in FIG. 20, the yarn Y is held at the bottom of the recess sections 3251, 3271 of the first guide members 325, 327 while being bent in such a way to leave the central axis 3171. When the lever 329 locking the second guide member 326, 328 is swiveled as shown by the chain double-dashed line in FIG. 19, the second guide members 326, 328 are placed in withdrawal positions at which the yarn can be introduced into the opening of the yarn passage 317 and into the recess sections 3251, 3271 of the first guide members 325, 327.

Figure 23:
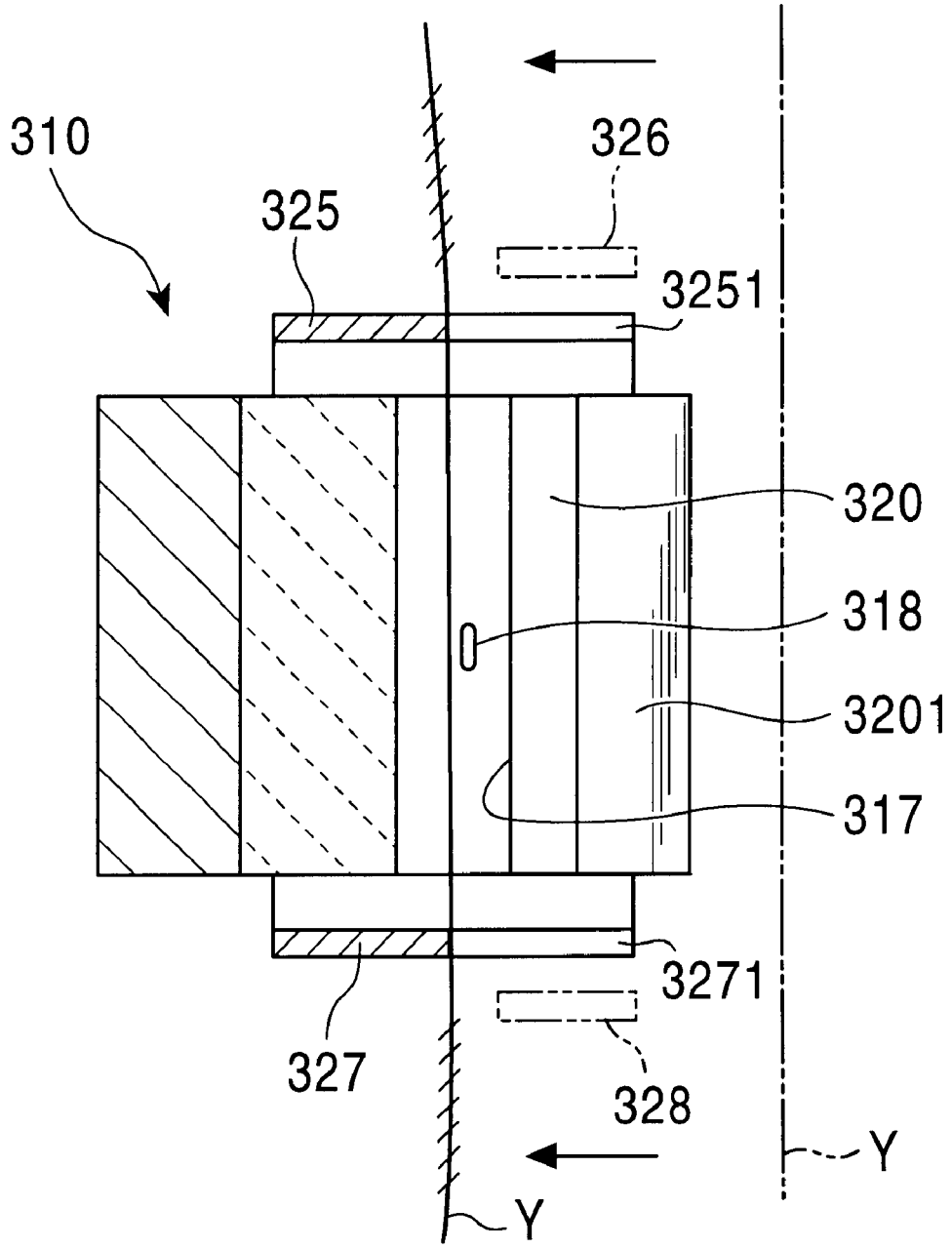
FIG. 23 is a side sectional view of the hairiness suppressing device in FIG. 19, in which second guide members are located at withdrawal positions.
Figure 24:
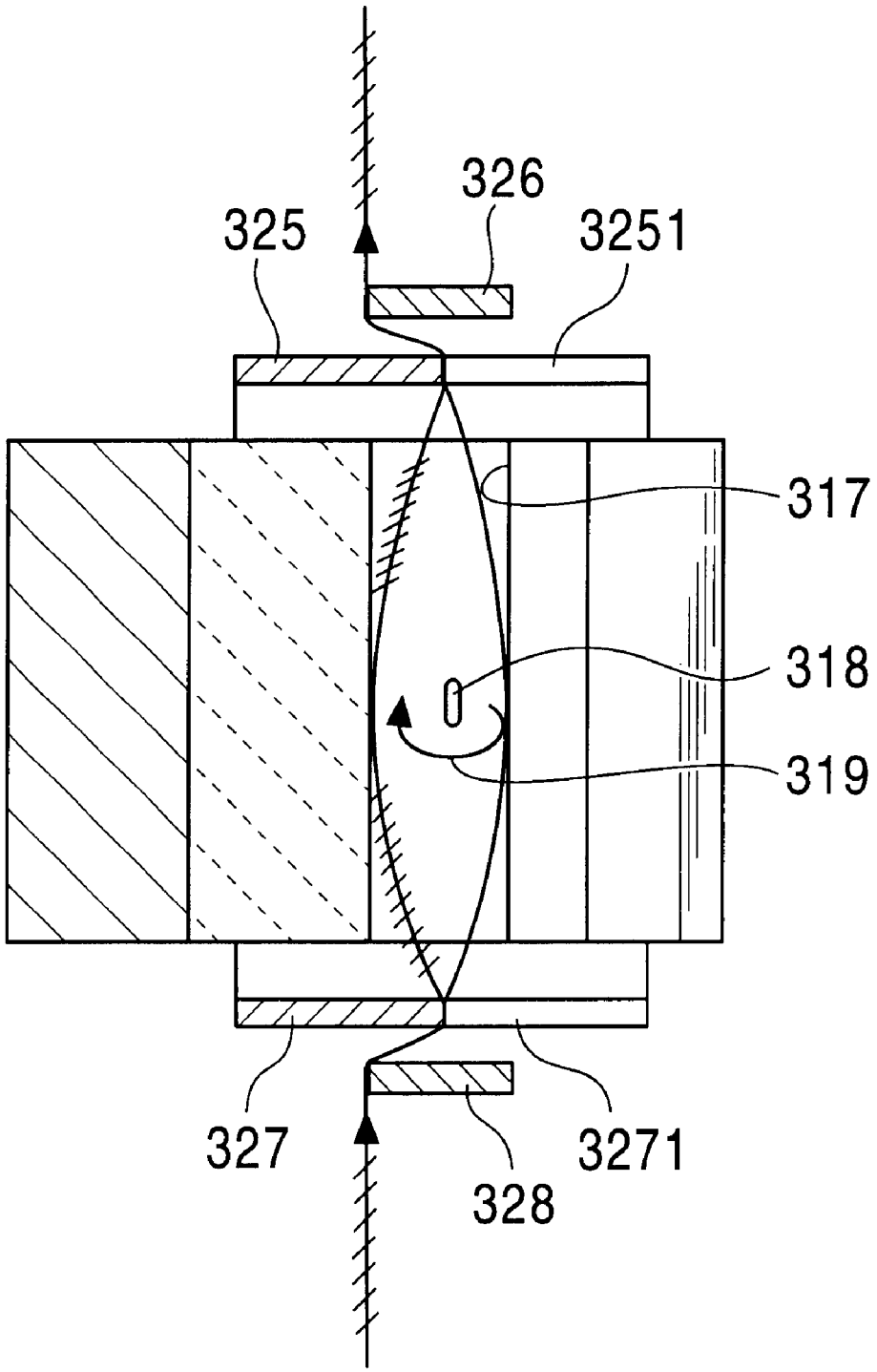
FIG. 24 is a side sectional view of the hairiness suppressing device in FIG. 19, in which second guide members are located at operating positions.

An operation of the hairiness suppressing device 310 having the above structure will be described with reference to FIGS. 23 and 24. FIG. 23 is a side sectional view of the hairiness suppressing device 310 in FIG. 19 in which the second guide members 326, 328 are at the withdrawal positions. FIG. 24 is a side sectional view of the hairiness suppressing device 310 in FIG. 19 in which the second guide members 326, 328 are at the operating positions.

In FIG. 23, since the second guide members 326, 328 are located at the withdrawal positions, the spun yarn Y shown by the chain double-dashed line is introduced into the yarn passage 317 through the inclined section 3201 and the opening 320, as shown by the arrow. The spun yarn Y in the yarn passage 317 is located at the bottom of the recess sections 3251, 3271 of the first guide members 325, 327. During introduction, the yarn Y, is not run and no gas is jetted from the gas-jetting hole 318.

In FIG. 24, the second guide members 326, 328 are located at the illustrated operating positions, while a gas is simultaneously jetted from the gas-jetting hole 318 to generate a whirling current in the yarn passage 317. Subsequently, the yarn Y is run from bottom to top as shown by the arrow in the drawing. Using the bottom of the recess sections 3251, 3271 of the first guide members 325, 327 as nodes, the yarn Y starts to be ballooned as shown in the drawing. Since the second guide members 326, 328 bend the yarn Y in such a direction as to further drive it to the bottom of the recess sections 3251, 3271, the yarn Y is held at the bottom of the recess sections 3251, 3271, while the first guide members 325, 327 and the second guide members 326, 328 bend the yarn Y to almost stop propagation of twisting applied to the yarn Y within the yarn passage 317.

The spun yarn Y is held at the center of the yarn passage 317, so it is ballooned uniformly and stably. This ballooning causes the spun yarn Y to be twisted. The spun yarn Y is formed by twisting short fibers and is originally twisted, for example, in Z directions, as shown in the drawing. The direction of the whirling current 319 is preferably such that the yarn Y is additionally twisted at the outlet side of the yarn passage 317 while being untwisted at the inlet side thereof. Due to twisting stop carried out by the guide members 325, 326, 327, 328 at the inlet and outlet limits, false-twisting based on the untwisted and additionally twisted parts of the yarn Y occurs only between the guide members 325 and 327. It is assumed that in the untwisted part, unwanted fibers that do not contribute to construction of the yarn Y are flung away, whereas in the additionally twisted part, hairinesses are caught in the yarn Y. This hairiness suppressing effect based on the untwisted and additionally twisted parts is effectively provided by twisting stop carried out by the guide members 325, 326, 327, 328.

If the extent to which the yarn Y is bent by the second guide members 326, 328 is small, then although the yarn Y is ballooned as described above, twisting caused by the whirling current 319 propagates to the upstream and downstream sides of the yarn passage 317, thereby reducing the distinction between additionally twisted and untwisted parts within the yarn passage 317. Thus, the hairiness suppressing effect based on the untwisted and additionally twisted parts becomes insufficient. On the other hand, if the yarn Y is bent too much, the yarn tension excessively increases to cause yarn breakage. The degree of twisting stop carried out by the first guide members 325, 327 and the second guide members 326, 328 can be adjusted based on the push-in amount for the second guide members 325, 327. In FIG. 19, an appropriate push-in amount for stopping propagation of twisting to the yarn Y can be set by changing the length of a stopper 391 mounted on the lever 329.

Even if the twisting stop means 312 is provided at the inlet side of the nozzle means 311 without the twisting stop means 313 at the outlet side or the twisting stop means 313 is provided at the outlet side of the nozzle means 311 without the twisting stop means 312 at the inlet side, twisting applied to the yarn Y by the whirling current is substantially stopped from propagating beyond at least either the inlet or outlet. As a result, the yarn Y is twisted or untwisted within a short section, while hairinesses are effectively caught in the fibers or unwanted fibers are effectively flung away. If the whirling current 319 causes the yarn Y to be additionally twisted at the outlet side of the yarn passage 317, the twisting stop means 313 provided at the outlet side of the nozzle means 311 allows hairinesses to be caught in the yarn Y after unwanted fibers have been flung away. Thus, preferably, the twisting stop means 312, 313 are provided at the inlet and outlet of the nozzle means 311.

In addition, according to the direction of twisting applied to the yarn Y, the whirling current may be formed such that the additionally twisted part is formed at the inlet side of the yarn passage 317, while the untwisted part is formed at the outlet side of the yarn passage 317. More preferably, however, the additionally twisted part is provided at the outlet side of the yarn passage 317 because this configuration allows hairinesses to be caught in the yarn after unwanted fibers have been flung away, thereby enabling reliable hairiness suppression.

In addition, the yarn Y may be held at a position eccentric to the yarn passage 317. However, by holding the yarn Y near the center of the yarn passage 317, the yarn Y is ballooned symmetrically due to the nodes along the central axis, resulting in stable ballooning.

Various means can be employed for the twisting stop means for the yarn Y. Means may be used that abuts two plates on each other to sandwich the yarn Y therebetween, or gate means may be used that pushes one plate in between two plates to bend the yarn Y in a zigzag manner. As shown in FIG. 24, however, the twisting stop means comprising the two guide members 325, 326 or 327, 328 is advantageous in that twisting can be stopped while maintaining the tension of the yarn Y at a low level, thereby reducing the possibility of yarn breakage.

In addition, by locking the first guide members 325, 327 having the recess sections 3251, 3271 that hold the yarn Y so that the second guide members 326, 328 can move toward the recess sections 3251, 3271, the second guide members 326, 328 are prevented from obstructing introduction of the yarn Y, which has passed through the opening 320 of the yarn passage 317, thereby enabling the first guide members 325, 327 to reliably hold the yarn Y.

Next, an automatic winder 301 in which the hairiness suppressing device 310 in FIG. 19 is installed will be described with reference to FIG. 25.

The automatic winder 301 comprises a large number of winding units 302 installed in a line. Each of the winding units 302 is configured to wind the yarn unwound from the supplying bobbin supplied at a predetermined position, into a package 304 rotated by a traverse drum 356 after passing the yarn through a balloon breaker 351, a tenser 352 for applying yarn tension, the hairiness suppressing device 310, a suction nozzle 353 for holding a supplying bobbin side yarn end (a lower end) upon yarn breakage, a slab catcher 354 for detecting defective parts of the yarn Y, and a yarn splicing device 355. In addition, a suction mouth (upper yarn suction pipe) 357 is provided above the yarn splicing device 355 for guiding a package 304 side yarn end to the yarn splicing device 355, while a relay pipe (lower yarn suction pipe) 358 is provided below the yarn splicing device 355 for guiding the lower end located at the supplying bobbin 303 side to the yarn splicing device 355.

As shown in FIG. 19, the tenser 352, the hairiness suppressing device 310, and the suction nozzle 359 are mounted on a side of a tenser box 359. The tenser 352 is of a gate type that engagingly places a movable comb edge 3522 relative to a fixed comb edge 3521. The movable comb edge 3522 is attached to the tip of an arm 3529, which is attached to a shaft 360 interlocked with the shaft 330. Thus, the second guide members 326, 328 of the hairiness suppressing device 310 and the comb edge 3522 of the tenser 3522 are opened and closed at the same time.

Figure 25:
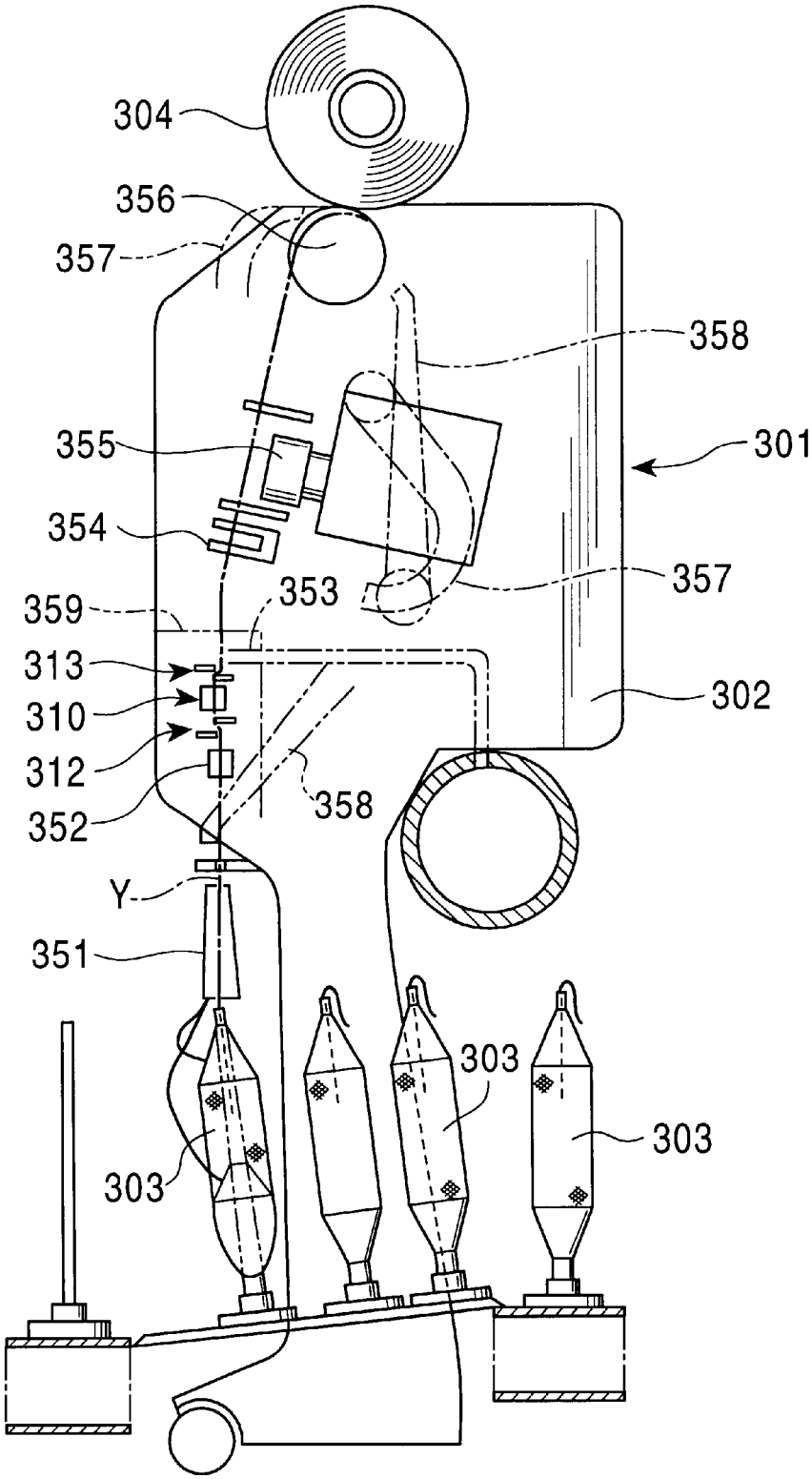
FIG. 25 is an equipment arrangement drawing of an automatic winder in which the hairiness suppressing device in FIG. 19 is installed according to a fourth embodiment.

In FIG. 25, when the traverse drum 356 of each winding unit 302 is driven to start rewinding the yarn Y, the twisting stop means 312, 313 having the above function executes effective hairiness processing when the yarn Y unwound from the supplying bobbin 303 passes the hairiness suppressing device 310. If a defect is found in the yarn Y being wound into the package 304, the yarn must be cut and spliced. In this case, gas jetting in the hairiness suppressing device 310 is stopped, and the supplying bobbin side yarn end is sucked and captured by the suction nozzle 353. Then, the relay pipe 358 is swiveled to the neighborhood of the balloon breaker 351 to suck the lower yarn being captured by the suction nozzle 353 in order to guide it to the yarn splicing device 353.

At this point, the tenser 352 of the tenser box 359 and the hairiness suppressing device 310 are open, so the yarn Y runs along the illustrated yarn path. At the same time, the suction mouth 357 sucks the package 304 side yarn end to guide it to the yarn splicing device 355, which then splices the yarn. Once splicing has been finished, each component of the tenser box 359 is actuated to start winding the yarn Y while subjecting it to hairiness suppressing processing.

The hairiness suppressing device 310 suppresses hairinesses that may occur during unwinding of the yarn Y from the supplying bobbin 303 or during application of tension by the tensor 352, thereby enabling the yarn Y to be rewound while suppressing hairinesses.

In addition, by placing the suction nozzle 353 near the outlet of the hairiness suppressing device 310, hairinesses from the hairiness suppressing device 310 can be collected without being splashed. In addition, a waxing device for waxing the yarn may be installed at the downstream side of (above) the hairiness suppressing device 310. The installation of the waxing device enables the hairiness suppressing device 310 to be disposed at the upstream side of (below) the tenser 352 if no space is available for the hairiness suppressing device 310 to be placed. More preferably, however, the hairiness suppressing device 310 is provided at the downstream side of the tenser 325 because this configuration suppresses hairinesses that may be caused by the tenser 352.

Instead of compressed air, humidified air containing vapors or water droplets can be used as a gas for generating a whirling current to twist the spun yarn Y formed by twisting fibers. The use of vapors enables heating of the yarn Y passing through the yarn passage 317 and of the inner periphery surface of the yarn passage 317, and the contact with the inner periphery surface of the yarn passage 317 causes the yarn to be heated as if it is ironed, thereby enabling heat set while maintaining a reduced amount of hairinesses. In addition, when exposed to humidified air or vapors, hairinesses on the yarn Y can be softened. Accordingly, hairinesses softened by false-twisting based on untwisting and additional twisting can be entangled with and caught in the yarn Y twisted through the yarn passage 317. Alternatively, dry heated air can be used as a gas for causing a whirling current.

Due to the above configuration for achieving the first object, the present invention has the following effects.

After a spun yarn has been introduced into the yarn passage in which a whirling current acts on the yarn, the cover member closes the yarn inserting opening to prevent the whirling flow from leaking from the yarn inserting opening. This configuration can improve the hairiness suppressing performance based on the ballooning of the yarn and reduce energy losses caused by the leakage of the whirling current.

Since the cover member is provided for the yarn presser guide, the yarn presser guide is swivellably moved to allow the cover member to open and close the yarn inserting opening, thereby eliminating the need for a separate drive mechanism for opening and closing the cover member.

Since the wedge-shape occludes the yarn inserting opening that opens into the yarn passage, the yarn can be perfectly ballooned in the yarn passage.

The hairiness suppressing device according to the present invention for achieving the second object can use the jet nozzle means to balloon (whirl) and false-twist a yarn in order to execute the hairiness suppressing processing that entangles hairinesses with the fibers for suppressing. By using the sucking means to suck the inside of the yarn passage simultaneously with this hairiness suppressing processing, this configuration can suck and remove dust or fluff leaving the yarn due to a whirling air flow or the ballooning (whirling) of the yarn.

As a result, the hairiness suppressing processing can be executed in a clean state to reduce the amount of dust or fluff caught in the fibers, thereby improving the quality of packages.

In addition, since the yarn trap of the winder is also used as the suction means, the device existing in the winder can be used to suck and remove dust or fluff. As a result, the present invention can be inexpensively placed in the winder without the need to provide a separate suction means.

Furthermore, when the suction means carries out suction in the tangential direction of the whirling air current, dust or fluff can be efficiently sucked and reliably removed from the yarn passage without disturbing the whirling air current (ballooning of the yarn) in the yarn passage.

Due to the above configuration for achieving the third object, the present invention has the following effects.

Since hairinesses protruding from the surface of the yarn can be effectively restrained and the ballooning enables a weak portion to be broken and removed, this configuration can prevent a yarn broken at a weak portion leading to the degradation of the working efficiency of a subsequent step, such as a warping step. As a result, the working efficiency of the subsequent step, such as a warping step, is improved.

Using the simple configuration including the whirling air current generation member for generating a whirling air current and the means for holding the yarn approximately at the center of the vertical hole in the whirling air current generation member at the gate of the whirling air current generation member, hairinesses protruding from the surface of the yarn can be effectively restrained and a weak portion can be broken and removed.

The means for holding the yarn approximately at the center of the vertical hole in the whirling air current generation member is composed of the fixed guide member disposed at the gate of the whirling air current generation member and the movable guide member that is urged toward the fixed guide member. Thus, the movable guide member can be rotationally moved away from the fixed guide member to withdraw so as not to obstruct the.introduction of the yarn into the vertical hole in the whirling air current generation member, thereby facilitating the insertion of the yarn into the vertical hole in the whirling air current generation member.

Due to the above configurations for achieving the fourth object, the hairiness suppressing device and automatic winder according to the present invention have the following effects. The twisting stop means substantially stops twisting applied to the yarn by the whirling current from propagating to the upstream and downstream sides of the yarn passage, thereby allowing yarn false-twisting based on untwisting and additional twisting to be carried out within a short section. As a result, hairinesses are effectively entangled with and caught in the fibers, or untwisting or ballooning during untwisting causes unwanted fibers to be effectively flung away, thereby suppressing hairinesses that may occur during a yarn rewinding step.

What is claimed is:

1. A hairiness suppressing device provided in a yarn path of an automatic winder that unwinds a spun yarn on a supplying side to wind it around a package, said device comprising:

a body having a yarn passage therethrough through which unwound yarn passes; and jet holes that open into the yarn passage in said body and from which a whirling air current is provided when a gas is jetted into the yarn passage; and suction means acting as a yarn trap and communicating with said yarn passage to suck the inside thereof.

2. A hairiness suppressing device as in claim 1, in which said winder includes a yarn trap for sucking the end of yarn broken on the supplying side of said winder, and in that:

the yarn trap is also operative for use as said suction means to suck the inside of said yarn passage.

3. A hairiness suppressing device as in claim 1 or claim 2, in which said suction means communicates tangentially with said yarn passage to suck the yarn tangentially from a whirling air current occurring in said yarn passage.

4. A hairiness suppressing device provided in a running path for a yarn formed by twisting fibers, the device comprising:

a body having a yarn passage through which said yarn passes and a nozzle means having holes from which a gas is jetted to cause a whirling current in the yarn passage, and a twisting stop means provided at at least either the inlet or outlet of said yarn passage, said twisting stop means providing means operative to hold said yarn to thereby substantially stop twisting movement applied to said yarn by said whirling current from propagating beyond at least either said inlet or said outlet.

5. A hairiness suppressing device as in claim 4, wherein said whirling current is formed in a direction to apply twisting to said yarn at the outlet side of said yarn passage.

6. A hairiness suppressing device as in claim 4 or claim 5, wherein said twisting stop means is provided at both the inlet and outlet of said yarn passage to substantially stop twisting applied to said yarn by said whirling current from propagating to both the upstream and the downstream sides of said yarn passage.

7. A hairiness suppressing device as in claim 6, wherein said yarn passage has a circular cross section and said twisting stop means holds said yarn at the inlet and at the outlet of said yarn passage to locate said yarn at the center of the circular cross section of said yarn passage.

8. A hairiness suppressing device as recited in claim 7, wherein said twisting stop means comprises two relatively movable guide members provided at each of the inlet and the outlet of said yarn passage, respectively, so that the two guide members cooperate to hold said yarn to substantially stop propagation of twisting thereof.

9. A hairiness suppressing device as in claim 7, wherein each of said first guide members being substantially aligned with the center of said yarn passage said twisting stop means comprises first guide members disposed closer to the inlet and the outlet respectively of said yarn passage, to position said yarn approximately at the center of the circular cross section of said yarn passage, and second guide members being disposed farther from the inlet and outlet of said yarn passage, respectively, said guide members being movable with respect to said first guide members and being operative to bend the yarn positioned by said first guide members from said center.

10. A hairiness suppressing device as in claim 9, wherein said yarn passage has an opening into which said yarn is inserted and which extends in a direction along the central axis, wherein said first guide member is fixed to a predetermined position and has a recess section that opens to said opening side, and wherein said second guide member is moved between a position at which said yarn is bent and held in the recess section of said first guide and a position at which the yarn can be introduced into the recess section of said first guide.

11. A hairiness suppressing device for an automatic winder as in claim 5, in which said hairiness suppressing device includes a yarn presser guide mounted for pivotal movement to advance said yarn or withdraw said yarn from said opening to said yarn passage, and said yarn presser member being connected to the cover member for movement with respect to said hairiness suppressing device.

12. A hairiness suppressing device as in claim 5, wherein said twisting stop means is provided adjacent the outlet of said yarn passage to substantially stop additional twisting applied to said yarn by said whirling current from propagating to the downstream side of said yarn passage.

13. An automatic winder for unwinding a spun yarn wound around a supplying bobbin to rewind it into a package, wherein the winder comprises:

a body having a yarn passage provided in a path for the unwound yarn said yarn passage containing holes from which a gas is jetted to cause a whirling current in the yarn passage, and a twisting stop means provided at least either the inlet or the outlet of said yarn passage to hold said yarn at least either the inlet or the outlet of said yarn passage to substantially stop twisting applied to said yarn by said whirling current from propagating beyond at least either said yarn passage inlet or outlet so that said yarn is located at the center of the circular cross section of said yarn passage.

14. A hairiness suppressing device for an automatic winder for unwinding a spun yarn on a supplying side to wind it around a package, said hairiness suppressing device being disposed in a yarn path of an automatic winder and including a yarn passage, means for injecting gas into said yarn passage for generating a whirling gas current to act on the yarn, said hairiness suppressing device comprising:

an opening to said passage including an enlarged divergent section and a slit communicating with said passage, a movable cover member shaped like a wedge for opening and closing said yarn inserting opening; and means for moving said cover member to and from said opening to said passage.

15. A yarn processing method including a body having a yarn passage extending therethrough and means for delivering yarn to said yarn passage, said method comprising the steps of:

holding said yarn in the center of said yarn passage;

imposing a whirling air current on said yarn in said yarn passage; and ballooning said yarn by said whirling air current to thereby suppress hairiness in the yarn and to sever any weakened portion of the yarn.

16. A yarn processing device comprising:

a body forming a whirling air current generation member, a vertical hole in said body, and means for holding a spun yarn substantially at the center of the vertical hole including a fixed guide member having an edge disposed in substantial alignment with said center of said vertical hole, a movable guide member having an edge operative to engage said yarn and for moving it into engagement with said edge of said fixed guide member, and means for moving said movable guide member.

* * * * *